US011525445B2

(12) United States Patent
Shimozono et al.

(10) Patent No.: US 11,525,445 B2
(45) Date of Patent: Dec. 13, 2022

(54) COMPRESSOR ASSEMBLY, COMPRESSOR, AND METHOD OF MANUFACTURING COMPRESSOR

(71) Applicant: DAIKIN INDUSTRIES, LTD., Osaka (JP)

(72) Inventors: Naoki Shimozono, Osaka (JP); Mikio Kajiwara, Osaka (JP); Tomomi Yokoyama, Osaka (JP); Kouji Kojima, Osaka (JP); Tsuyoshi Fukunaga, Osaka (JP); Mahoba Ogawa, Osaka (JP); Yasuhiro Yamamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 579 days.

(21) Appl. No.: 16/321,445

(22) PCT Filed: Jul. 25, 2017

(86) PCT No.: PCT/JP2017/026924
§ 371 (c)(1),
(2) Date: Jan. 28, 2019

(87) PCT Pub. No.: WO2018/021345
PCT Pub. Date: Feb. 1, 2018

(65) Prior Publication Data

US 2021/0285449 A1 Sep. 16, 2021

(30) Foreign Application Priority Data

Jul. 29, 2016 (JP) ..... 2016-150666
Jul. 29, 2016 (JP) ..... JP2016-150665

(51) Int. Cl.
*F04C 23/02* (2006.01)

(52) U.S. Cl.
CPC ..... *F04C 23/02* (2013.01); *F04C 2230/91* (2013.01); *F04C 2240/40* (2013.01); *F04C 2240/803* (2013.01); *F04C 2280/04* (2013.01)

(58) Field of Classification Search
CPC .. F04C 23/02; F04C 2230/91; F04C 2240/40; F04C 2240/803; F04C 2280/04
See application file for complete search history.

(56) References Cited

U.S. PATENT DOCUMENTS 6,290,528 B1 * 9/2001 Moore, Jr. ..... H01R 13/5216 439/271
6,851,962 B2 * 2/2005 McCormack, III .. H01R 13/748 439/276

(Continued)

FOREIGN PATENT DOCUMENTS

EP 1 219 726 A1 7/2002
EP 1 959 138 A1 8/2008

(Continued)

OTHER PUBLICATIONS

International Preliminary Report of corresponding PCT Application No. PCT/JP2017/026924 dated Feb. 7, 2019.

(Continued)

*Primary Examiner* — Connor J Tremarche
(74) *Attorney, Agent, or Firm* — Global IP Counselors, LLP

(57) ABSTRACT

A compressor assembly becomes a compressor as a result of a terminal guard being attached. The compressor assembly includes a body, and a terminal guard mounting seat attached to an outer surface of the body. The terminal guard is attachable to the terminal guard mounting seat. A compressor includes the compressor assembly and the terminal guard. The compressor can be manufactured by attaching the terminal guard mounting seat to the outer surface, administering metal spraying to at least part of the outer surface (Continued)

after attaching the terminal guard mounting seat, and attaching the terminal guard to the terminal guard mounting seat after the administering metal spraying.

20 Claims, 25 Drawing Sheets

(56) References Cited

U.S. PATENT DOCUMENTS

| | | | | |
|---|---|---|---|---|
| 7,935,888 | B2 * | 5/2011 | Hansen | H02K 5/225 174/67 |
| 8,801,400 | B2 * | 8/2014 | Thibodeaux | H01R 13/639 361/728 |
| 9,480,177 | B2 * | 10/2016 | Trudeau, Jr. | F04D 27/008 |
| 2002/0163785 | A1 * | 11/2002 | Brechbill | F04B 39/12 361/730 |
| 2003/0194576 | A1 * | 10/2003 | Cooper | C23C 28/00 428/626 |
| 2009/0233498 | A1 * | 9/2009 | Nakajima | F04B 39/121 439/892 |

FOREIGN PATENT DOCUMENTS

| | | | |
|---|---|---|---|
| EP | 2 816 232 | A1 | 12/2014 |
| JP | 11-22685 | A | 1/1999 |
| JP | 2002-303272 | A | 10/2002 |
| JP | 2007-146728 | A | 6/2007 |
| JP | 2011-509342 | A | 3/2011 |
| JP | 2013-167202 | A | 8/2013 |
| TW | 502086 | B | 9/2002 |
| WO | 2009/078842 | A1 | 6/2009 |

OTHER PUBLICATIONS

International Search Report of corresponding PCT Application No. PCT/JP2017/026924 dated Sep. 26, 2017.
European Search Report of corresponding EP Application No. 17 83 4347.1 dated Jun. 13, 2019.

* cited by examiner

COMPRESSOR ASSEMBLY, COMPRESSOR, AND METHOD OF MANUFACTURING COMPRESSOR

CROSS-REFERENCE TO RELATED APPLICATIONS

This U.S. National stage application claims priority under 35 U.S.C. § 119(a) to Japanese Patent Applications No. 2016-150665 and 2016-150666, both filed in Japan on Jul. 29, 2016, the entire contents of which are hereby incorporated herein by reference.

TECHNICAL FIELD

The present invention relates to a compressor assembly that becomes a compressor as a result of a terminal guard being attached, and a compressor that is manufactured from the compressor assembly, and a method of manufacturing the compressor.

BACKGROUND ART

A compressor used in a refrigerating system has a casing configured from plural members formed of metal such as carbon steel and cast iron. A surface treatment for inhibiting damage caused by rust, for example, and improving corrosion resistance is administered to the outer surface of the casing of the compressor. The corrosion resistance of the casing is an important characteristic for extending the product life of the compressor. In particular, the casing of a compressor used in a marine environment is required to have high corrosion resistance because it is easily exposed to spray and mist including seawater components and it is subject to sudden temperature changes. Compressors used in a marine environment include, for example, compressors for refrigerating systems used in marine containers that are loaded onto a container ship and transported across the ocean.

In compressors used in home air conditioners, for example, there are cases where a coating resulting from the painting of an oil paint or resin, for example, is formed on the outer surface of the casing to improve corrosion resistance. However, a coating formed by painting is vulnerable to changes in temperature, the infiltration of water to the interface, and physical shocks. For that reason, depending on the use environment, sometimes the coating cracks and sometimes the coating separates from the surface of the substrate of the casing. In the case of a compressor used in a marine environment, if the substrate of the casing is exposed to the outside air due to cracking and separation of the coating, it becomes extremely easy for corrosion of the casing to progress. Additionally, if the compressor sustains damage due to corrosion of the casing, there is the concern that a large economic loss will occur because it is usually difficult to repair a compressor in a marine environment. For that reason, the casing of a compressor used in a marine environment needs to have a particularly high corrosion resistance.

Conventionally, as disclosed in JP-A No. 2002-303272 and JP-A No. 2011-509342, in compressors used in a marine environment, methods that improve the corrosion resistance of the casing by using thermal spraying to form a metal coating on the outer surface of the casing are used. Thermal spraying is a surface treatment technique in which a thermal spray material heated to liquid droplets is sprayed onto the surface of a substrate that is the process target to thereby form a coating on the surface. In the case of a thermal spraying process for the casing of a compressor, a metal whose ionization tendency is greater than that of the main component of the material of the casing is used as the thermal spray material. In this case, the thermal spray coating that is the metal coating formed by the thermal spraying is corroded more easily than the casing that is the substrate, so the thermal spray coating has the effect of inhibiting corrosion and damage due to rusting of the casing. Furthermore, the thermal spray coating has a high adhesive strength to the substrate and a high durability to temperature changes and physical shocks compared to a coating resulting from painting. For that reason, the outer surface of a casing on which a thermal spray coating has been formed is less likely to be exposed to the outside air by cracking and separation of the coating.

SUMMARY

The casing of a compressor has various projecting portions and has a complex shape. The projecting portions are members that project from the outer surface of the casing, such as refrigerant pipes, a terminal guard, and a mounting foot. On the outer surfaces of the projecting portions and the outer surface of the casing around the projecting portions are formed difficult-to-spray regions where it is difficult to carry out the process of spraying the thermal spray material because they are in shadows. The difficult-to-spray regions tend to have a small thermal spray coating thickness and a low corrosion resistance compared to other regions of the outer surface of the casing. In order to also form on the difficult-to-spray regions a thermal spray coating of about the same thickness as the other regions of the outer surface of the casing, it is necessary to spray the thermal spray material at a right angle to the difficult-to-spray regions. However, because the casing having the projecting portions has a complex shape, it is difficult to form a uniform thermal spray coating on the entire outer surfaces of the projecting portions and the casing. In particular, a terminal guard, which is a projecting portion that is erectly provided around a terminal that projects from the outer surface of the casing, is attached to the outer surface of the casing, so it is difficult to spray the thermal spray material from appropriate directions onto the outer surface of the casing around the attachment position of the terminal guard.

It is an object of the present invention to provide a compressor having a good thermal spray coating formed around the terminal guard, and a compressor assembly that is a semi-manufactured product of the compressor, and a method of manufacturing the compressor.

A compressor assembly pertaining to a first aspect of the invention becomes a compressor as a result of a terminal guard being attached. The compressor assembly has a body and a terminal guard mounting seat. The terminal guard mounting seat is attached to an outer surface of the body, and the terminal guard becomes attached to the terminal guard mounting seat.

This compressor assembly is a semi-manufactured product of the compressor and is the compressor in a state in which the terminal guard for protecting a terminal connected to a power supply has not been attached. Just the terminal guard mounting seat for attaching the terminal guard is attached to the outer surface of the body around the terminal. For that reason, when administering metal spraying to the outer surface of the body, a good thermal spray coating can also be formed on the outer surface around the terminal guard mounting seat. This is because after the terminal guard has been attached to the body it is difficult to form a good thermal spray coating on the outer surface that is in the shadow of the terminal guard. Consequently, this compressor assembly can manufacture the compressor having a good thermal spray coating formed also around the terminal guard. Furthermore, in this compressor assembly, terminal guards of various shapes can be attached to the terminal guard mounting seat. For that reason, this compressor assembly can manufacture the compressor in which it is easy to replace the terminal guard.

A compressor assembly pertaining to a second aspect of the invention is the compressor assembly pertaining to the first aspect, wherein metal spraying is administered to at least part of the outer surface of the body.

In this compressor assembly, metal spraying is administered to the outer surface of the body to which the terminal guard mounting seat has been attached. The terminal guard has not been attached to the terminal guard mounting seat. For that mason, in this compressor assembly, when administering the metal spraying to the outer surface of the body, a good thermal spray coating can also be formed on the outer surface around the terminal guard mounting seat.

A compressor pertaining to a third aspect of the invention has the compressor assembly pertaining to the first aspect or the second aspect and a terminal guard attached to the compressor assembly.

In this compressor, a good thermal spray coating is also formed on the portion that projects from the outer surface of the casing. Furthermore, in this compressor, it is easy to replace the terminal guard.

A compressor pertaining to a fourth aspect of the invention is the compressor pertaining to the third aspect, wherein the terminal guard is made of stainless steel.

In this compressor, the terminal guard is made of stainless steel, so corrosion resistance is high even without administering the metal spraying. For that reason, depending on the use environment of the compressor, the metal spraying of the terminal guard can be omitted from the manufacturing process of the compressor. Consequently, with this compressor, the cost of the manufacturing process can be reduced.

A compressor pertaining to a fifth aspect of the invention is the compressor pertaining to the third aspect or the fourth aspect, wherein the terminal guard is erectly provided around a terminal that projects from the outer surface.

In this compressor, a good thermal spray coating is formed around the terminal guard.

A compressor pertaining to a sixth aspect of the invention is the compressor pertaining to the fifth aspect, wherein the terminal guard is attached to the terminal guard mounting seat by securing members or welding.

In this compressor, in a case where the terminal guard is attached to the terminal guard mounting seat by securing members such as bolts and nuts, it is easy to replace the terminal guard. Furthermore, in this compressor, in a case where the terminal guard is attached to the terminal guard mounting seat by welding, the terminal guard can be strongly secured to the terminal guard mounting seat.

A compressor pertaining to a seventh aspect of the invention is the compressor pertaining to the fifth aspect or the sixth aspect, wherein the terminal guard mounting seat has a tubular portion. One end portion of the tubular portion is attached to the outer surface of the body. The other end portion of the tubular portion has the terminal guard attached to it.

In this compressor, the terminal guard mounting seat has the tubular portion, so the terminal guard mounting seat can be easily secured to the outer surface of the body.

A compressor pertaining to an eighth aspect of the invention is the compressor pertaining to the fifth aspect or the sixth aspect, wherein the terminal guard mounting seat has a columnar portion. One end portion of the columnar portion is attached to the outer surface of the body. The other end portion of the columnar portion has the terminal guard attached to it.

In this compressor, the terminal guard mounting seat has the columnar portion, so the terminal guard mounting seat can be easily secured to the outer surface of the body.

A compressor pertaining to a ninth aspect of the invention is the compressor pertaining to the eighth aspect, wherein the terminal guard mounting seat has at least two of the columnar portions disposed in positions that sandwich the terminal.

In this compressor, the terminal guard can be stably secured.

A compressor pertaining to a tenth aspect of the invention is the compressor pertaining to the fifth aspect or the sixth aspect, wherein the terminal guard mounting seat has a bowl-shaped portion. A bottom portion of the bowl-shaped portion is attached to the outer surface of the body. An end portion on the opposite side of the bottom portion of the bowl-shaped portion has the terminal guard attached to it.

In this compressor, the bottom portion of the bowl-shaped portion of the terminal guard mounting seat is attached to the outer surface of the body, so the terminal guard mounting seat is strongly secured to the outer surface of the body.

A compressor manufacturing method pertaining to an eleventh aspect of the invention is a method of manufacturing the compressor of any one of the third aspect to the tenth aspect, which has a body and a terminal guard erectly provided around a terminal that projects from an outer surface of the body, the method having a terminal guard mounting seat attachment step, a body spraying step, and a terminal guard attachment step. The terminal guard mounting seat attachment step is a step of attaching to the outer surface of the body a terminal guard mounting seat to which the terminal guard becomes attached. The body spraying step is a step of administering metal spraying to at least part of the outer surface of the body after the terminal guard mounting seat attachment step. The terminal guard attachment step is a step of attaching the terminal guard to the terminal guard mounting seat after the body spraying step.

In this compressor manufacturing method, a metal coating for improving corrosion resistance is formed by thermal spraying on the outer surface of the body of the compressor in a state in which the terminal guard for protecting a terminal connected to a power supply has not been attached. When the metal spraying is administered, just the terminal guard mounting seat for attaching the terminal guard is attached to the outer surface of the body around the terminal. For that reason, when administering the metal spraying to the outer surface of the body, a good thermal spray coating can also be formed on the outer surface around the terminal. This is because after the terminal guard has been attached to the body it is difficult to form a good thermal spray coating on the outer surface that is in the shadow of the terminal guard. Consequently, in this compressor manufacturing method, the compressor having a good thermal spray coating formed around the terminal guard can be manufactured.

A compressor manufacturing method pertaining to a twelfth aspect of the invention is the compressor manufacturing method pertaining to the eleventh aspect and further has a terminal guard spraying step. The terminal guard spraying step is a step of administering metal spraying to the terminal guard before it is attached to the terminal guard mounting seat in the terminal guard attachment step. The terminal guard attachment step is a step of attaching to the terminal guard mounting seat the terminal guard to which the metal spraying has been administered in the terminal guard spraying step.

In this compressor manufacturing method, the metal spraying is administered to the terminal guard before attaching the terminal guard to the terminal guard mounting seat. When just the terminal guard is metal sprayed before it is attached to the terminal guard mounting seat, it is easier to handle the terminal guard at the time of the thermal spraying than it is when the terminal guard is metal sprayed after it has been attached to the terminal guard mounting seat. For that reason, even if the terminal guard has a complex shape, a good metal coating can be formed by spraying the thermal spray material from appropriate directions onto the entire outer surface of the terminal guard. Consequently, in this compressor manufacturing method, a good thermal spray coating can be formed on the terminal guard.

In the compressor assembly pertaining to the first aspect and the second aspect, the compressor having a good thermal spray coating formed also around the terminal guard can be manufactured. Furthermore, this compressor assembly can manufacture the compressor in which it is easy to replace the terminal guard.

In the compressor pertaining to the third aspect, a good thermal spray coating is also formed around the terminal guard. Furthermore, in this compressor, it is easy to replace the terminal guard.

In the compressor pertaining to the fourth aspect, the cost of the manufacturing process can be reduced.

In the compressor pertaining to the fifth aspect, a good thermal spray coating is formed around the terminal guard.

In the compressor pertaining to the sixth aspect, it is easy to replace the terminal guard, and the terminal guard can be strongly secured to the terminal guard mounting seat.

In the compressor pertaining to the seventh aspect, the terminal guard mounting seat can be easily secured to the outer surface of the body.

In the compressor pertaining to the eighth aspect, the terminal guard mounting seat can be easily secured to the outer surface of the body.

In the compressor pertaining to the ninth aspect, the terminal guard can be stably secured.

In the compressor pertaining to the tenth aspect, the terminal guard mounting seat is strongly secured to the outer surface of the body.

In the compressor manufacturing method pertaining to the eleventh aspect, the compressor having a good thermal spray coating formed around the terminal guard can be manufactured.

In the compressor manufacturing method pertaining to the twelfth aspect, a good thermal spray coating can be formed on the terminal guard.

BRIEF DESCRIPTION OF DRAWINGS

FIG. 5(*b*) is an external view, seen from the side, of the terminal guard mounting seat 14 attached to the outer surface of the middle portion 11.

FIG. 6(*b*) is a bottom view of the terminal guard 31.

FIG. 9(*b*) is an external view, seen from the side, of the terminal guard 31 attached to the terminal guard mounting seat 14.

FIG. 22(*b*) is a bottom view of the terminal guard 431.

FIG. 23 is a sectional view along line segment XXIII-XXIII of FIG. 21 and FIG. 22.

DETAILED DESCRIPTION OF EMBODIMENT(S)

A compressor assembly pertaining to an embodiment of the invention, and a compressor manufactured from the compressor assembly, and a method of manufacturing the compressor will be described with reference to the drawings. The compressor is, for example, used in a refrigerating system attached to a marine container. The compressor compresses refrigerant gas that circulates in a refrigerant circuit of the refrigerating system.

(1) Overall Configuration of Compressor

A compressor 101 of the present embodiment is a scroll compressor. A scroll compressor compresses refrigerant using a pair of scroll members having spiral wraps that fit together. However, the compressor 101 is not limited to a scroll compressor and, for example, may also be a rotary compressor.

Figure 1:
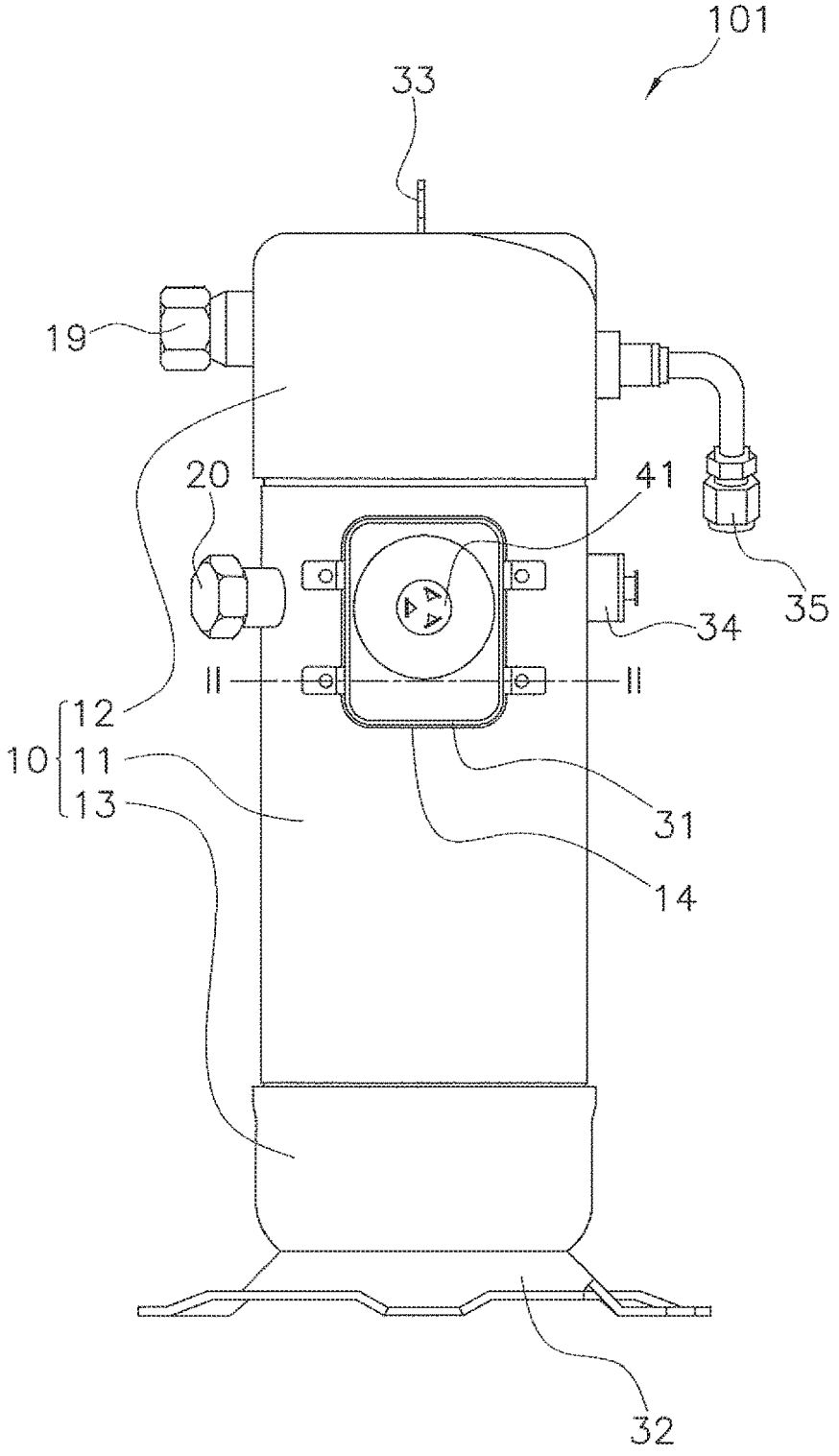
FIG. 1 is a front view of a compressor 101 pertaining to an embodiment.
Figure 2:
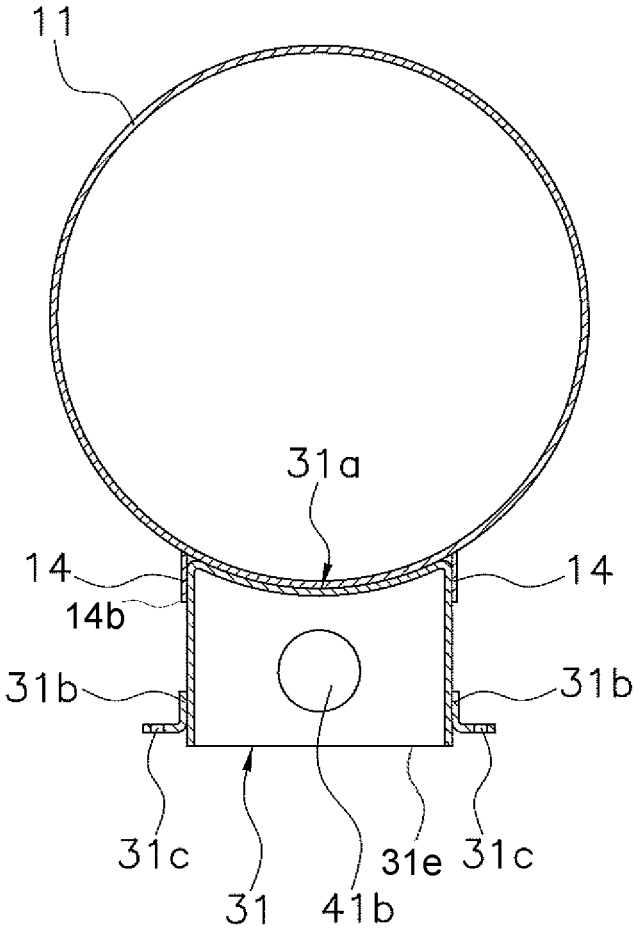
FIG. 2 is a sectional view along line segment II-II of FIG. 1.

FIG. 1 is a front view of the compressor 101. FIG. 2 is a sectional view along line segment II-II of FIG. 1. In FIG. 2, parts housed inside a casing 10 are omitted. The compressor 101 has a casing 10. The casing 10 is formed by a rigid member that is unlikely to be deformed or damaged by changes in pressure and temperature in the space inside and the space outside the casing 10. The material of the casing 10 is, for example, metal including carbon steel and iron such as cast iron.

Inside the casing 10 are housed a compression mechanism, a drive motor, and a crankshaft, for example. The compression mechanism is coupled to the drive motor via the crankshaft. The drive motor uses electrical power supplied from a power supply outside the casing 10 to rotate the crankshaft. The rotation of the crankshaft causes one of the pair of scroll members to revolve, thereby changing the volume of the space enclosed by the pair of scroll members, whereby the compression mechanism compresses the refrigerant.

The casing 10 is configured from an open cylinder-shaped middle portion 11, a bowl-shaped top portion 12, and a bowl-shaped bottom portion 13. The top portion 12 is airtightly joined to the upper end portion of the middle portion 11. The bottom portion 13 is airtightly joined to the lower end portion of the middle portion 11. Hereinafter, parts that become attached to the middle portion 11 will be generically called externally attached parts. The externally attached parts include not only parts that become attached to the outer surface of the middle portion 11 but also the top portion 12 and the bottom portion 13. The material of the externally attached parts is, for example, metal including carbon steel and iron such as cast iron.

A terminal guard mounting seat 14, a discharge pipe 20, a terminal guard 31, and a sensor mounting seat 34 are attached as externally attached parts to the side surface of the middle portion 11. A suction pipe 19 and an injection pipe 35 are attached as externally attached parts to the side surface of the top portion 12. A hanger 33 is attached as an externally attached part to the upper surface of the top portion 12. A mounting foot 32 is attached as an externally attached part to the lower surface of the bottom portion 13.

The terminal guard 31 is a member for protecting a terminal 41 connected to the drive motor inside the casing 10. The terminal 41 projects from the outer surface of the middle portion 11. The terminal guard 31 is attached to the terminal guard mounting seat 14, which is secured to the outer surface of the middle portion 11. The detailed configurations of the terminal guard 31 and the terminal guard mounting seat 14 will be described later.

The mounting foot 32 is a member for securing the compressor 101 to an installation surface. The mounting foot 32 has, for example, bolt holes for securing it with bolts to the installation surface. In the case of installing the compressor 101 in a marine container, for example, it is preferred that the mounting foot 32 be secured to the installation surface via a rubber vibration isolator to inhibit the vibration of the compressor 101 from propagating to the entire marine container via the mounting foot 32.

The hanger 33 is a member for hanging the compressor 101. The hanger 33 has, for example, an annular portion for catching a hook or the like. The hanger 33 is used to hang the compressor 101 when, for example, assembling and transporting the compressor 101.

The sensor mounting seat 34 is a member for attaching a temperature sensor or the like to the middle portion 11. The temperature sensor is used, for example, to measure the temperature of the outer surface of the middle portion 11 to monitor the temperature of the refrigerant inside the compressor 101.

The injection pipe 35 is a member for injecting intermediate-pressure refrigerant into the compression mechanism to enhance the efficiency of the refrigeration cycle.

(2) Assembly Process of Compressor

Figure 3:
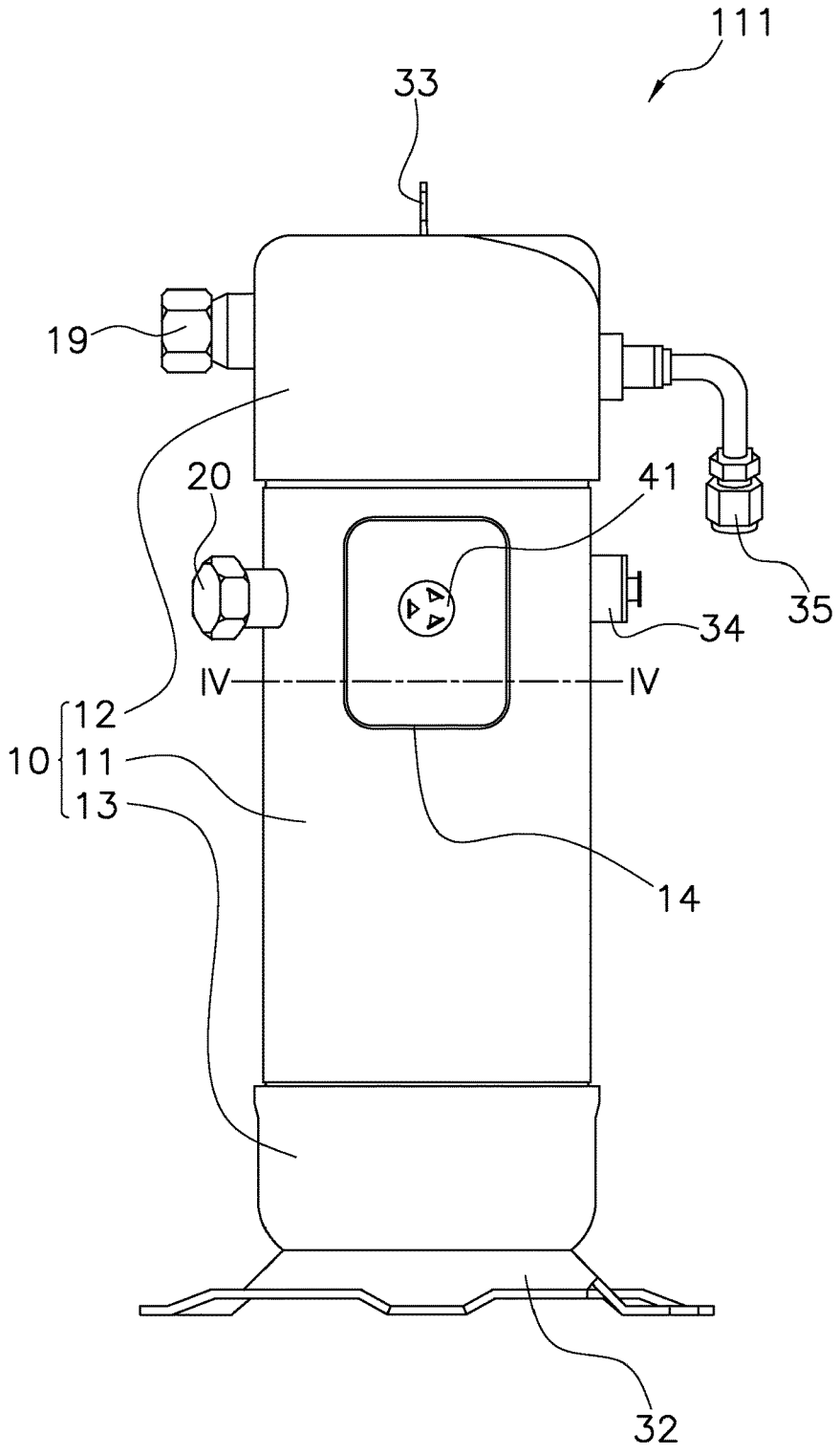
FIG. 3 is a front view of a compressor assembly 111 pertaining to the embodiment.
Figure 4:
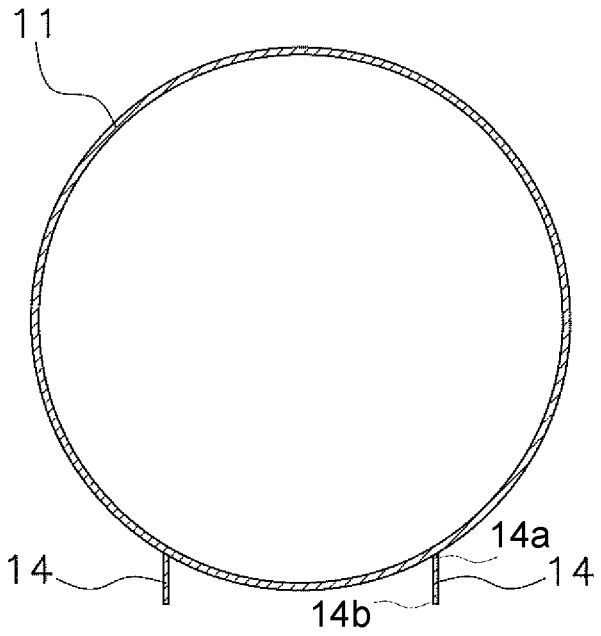
FIG. 4 is a sectional view along line segment IV-IV of FIG. 3.

A compressor assembly 111 of the present embodiment is a semi-manufactured product of the compressor 101 and corresponds to the compressor 101 in a state in which the terminal guard 31 has not been attached. FIG. 3 is a front view of the compressor assembly 111. FIG. 4 is a sectional view along line segment IV-IV of FIG. 3. In FIG. 4, parts housed inside the casing 10 are omitted.

In the manufacturing process of the compressor assembly 111, the terminal guard mounting seat 14 is attached to the outer surface of the middle portion 11. The terminal guard mounting seat 14 is a tubular member close to a quadrangular prism with curved corner portions. The terminal guard mounting seat 14 has a first end portion 14*a* that is attached to the outer surface of the middle portion 11 and a second end portion 14*b* that is spaced away from the outer surface of the middle portion 11. As shown in FIG. 3, the terminal guard mounting seat 14 is attached to the outer surface of the middle portion 11 so as to surround the terminal 41. The terminal guard mounting seat 14 has a shape into which the terminal guard 31 becomes fitted. As shown in FIG. 2, the terminal guard 31 can be fitted into the terminal guard mounting seat 14 in such a way that the outer peripheral surface of the terminal guard 31 contacts the inner peripheral surface of the terminal guard mounting seat 14. The terminal guard 31 that has been fitted into the terminal guard mounting seat 14 projects from the terminal guard mounting seat 14.

Figure 5:
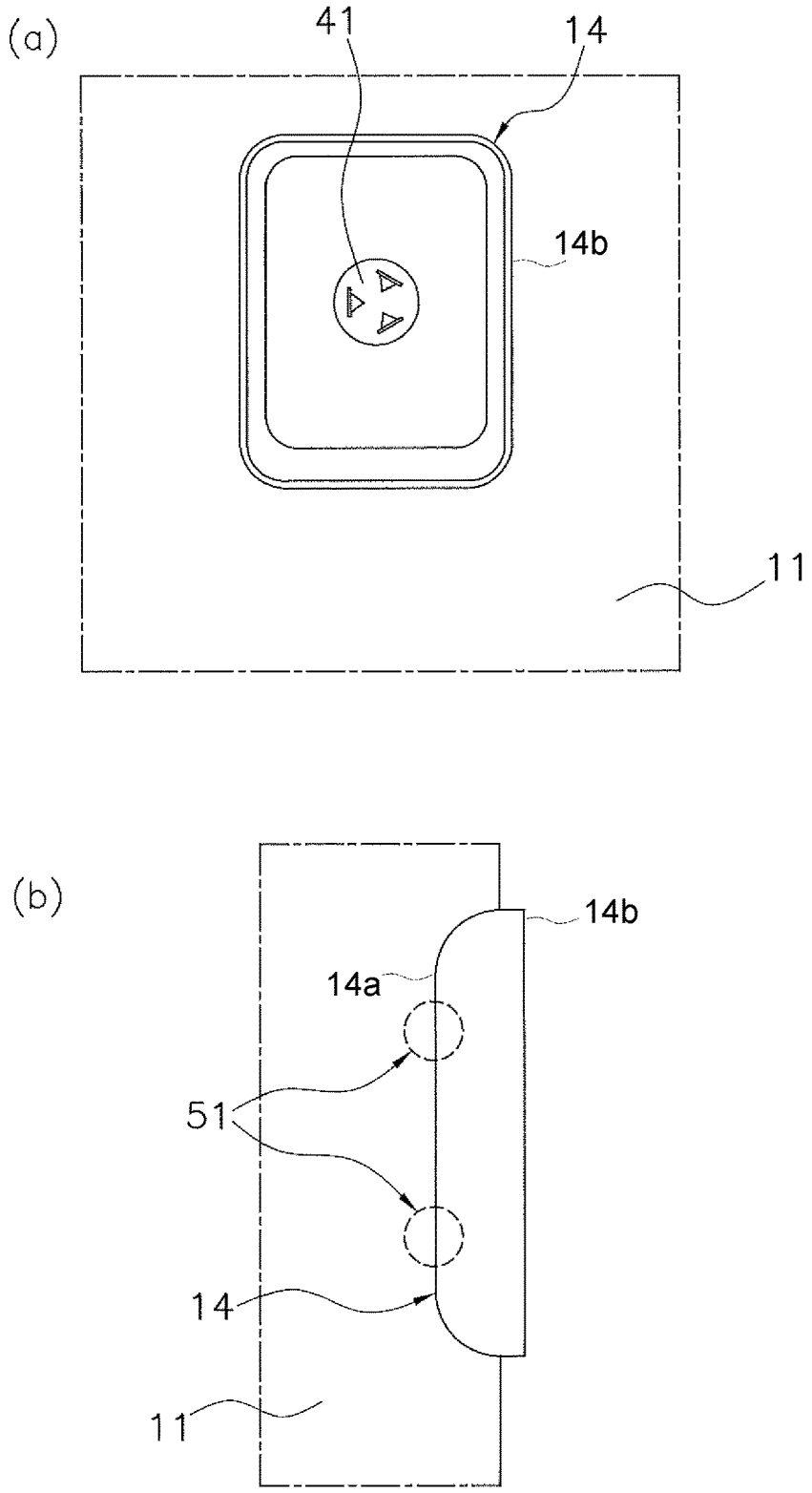
FIG. 5(*a*) is an external view, seen from the front, of a terminal guard mounting seat 14 attached to an outer surface of a middle portion 11.

FIG. 5(*a*) is an external view, seen from the font, of the terminal guard mounting seat 14 attached to the outer surface of the middle portion 11. FIG. 5(*b*) is an external view, seen from the side, of the terminal guard mounting seat 14 attached to the outer surface of the middle portion 11. The terminal guard mounting seat 14 is attached to the outer surface of the middle portion 11 by welding at four weld points 51. In FIG. 5(*b*), two weld points 51 are shown as circular regions surrounded by dotted lines. Two weld points 51 are also present on the opposite side of the side surface of the terminal guard mounting seat 14 shown in FIG. 5(*b*). The number of the weld points 51 is appropriately set in accordance with, for example, the dimensions and the shape of the terminal guard mounting seat 14. The gap between the terminal guard mounting seat 14 and the middle portion 11 is filled with a caulking agent. The caulking agent prevents water and the like from getting inside the terminal guard mounting seat 14. It will be noted that the terminal guard mounting seat 14 may also be welded to the outer surface of the middle portion 11 along the entire periphery of the terminal guard mounting seat 14 rather than being welded to the outer surface of the middle portion 11 at the four weld points 51. In this case, the gap between the terminal guard mounting seat 14 and the middle portion 11 does not need to be filled with a caulking agent.

Figure 6:
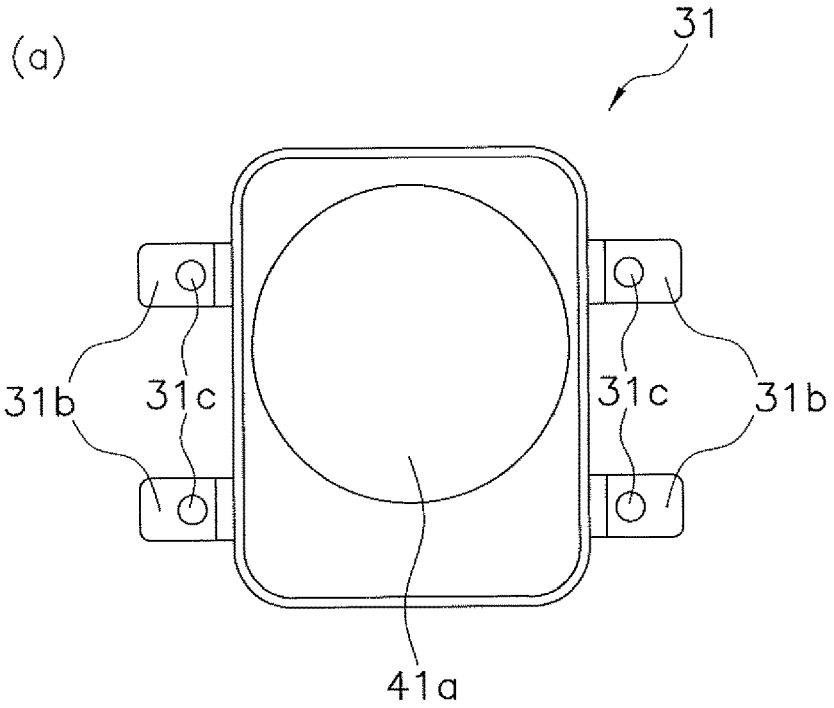
FIG. 6(*a*) is a front view of a terminal guard 31.
Figure 6:
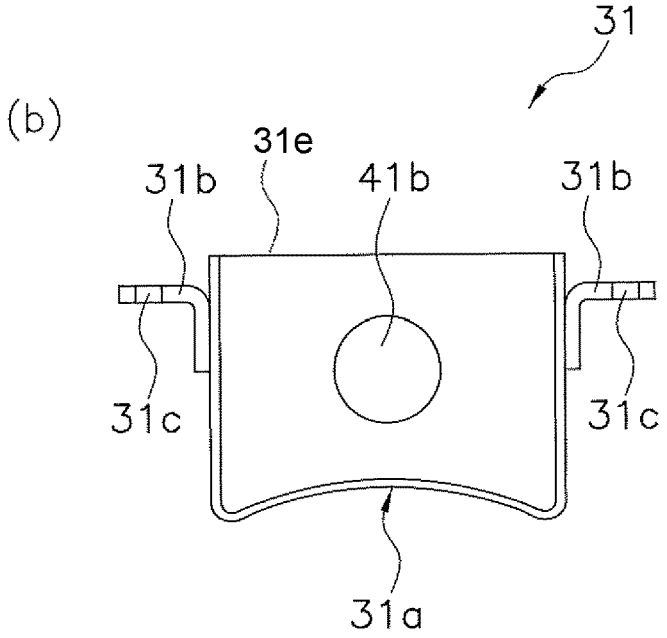
Figure 7:
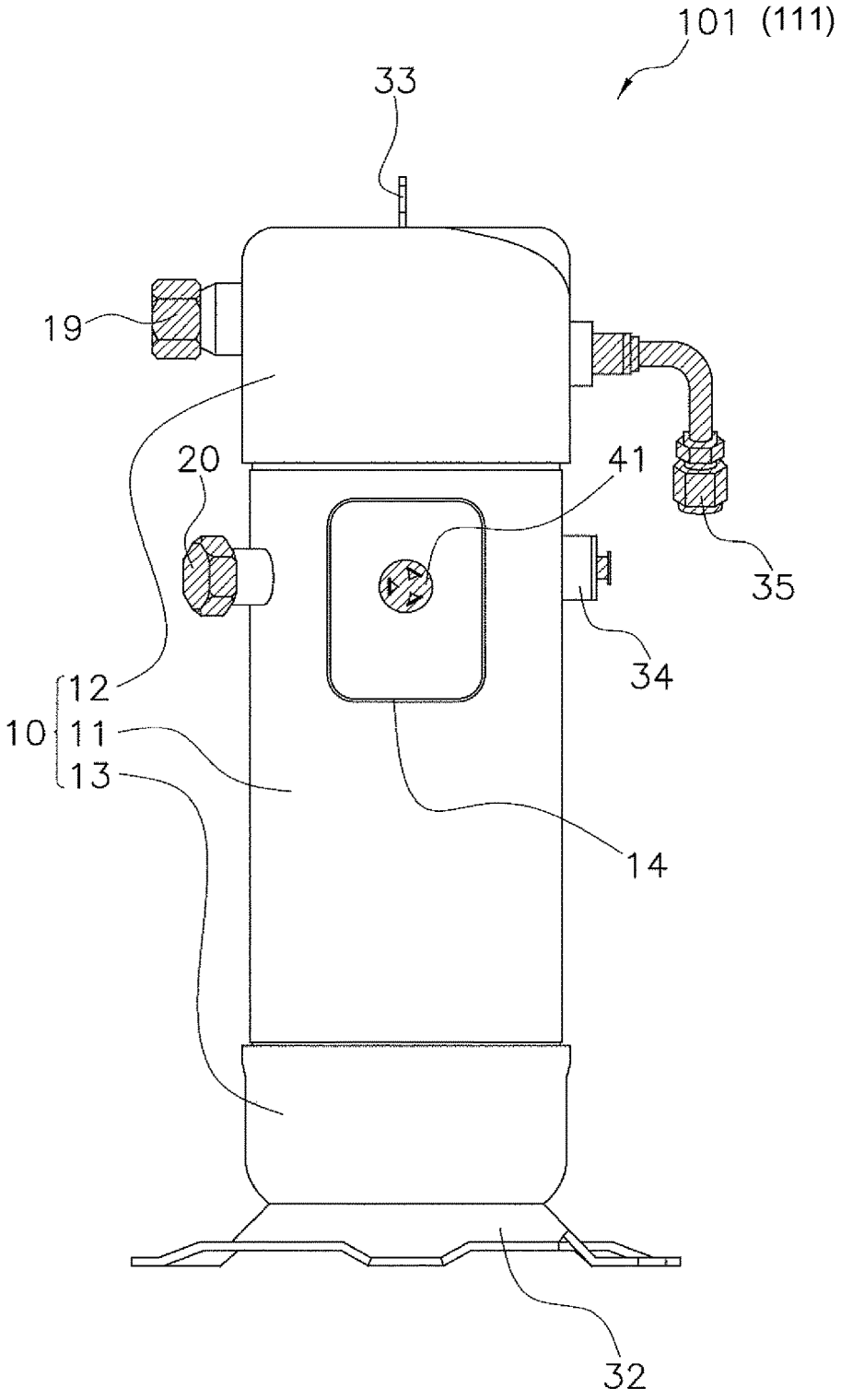
FIG. 7 is a drawing for describing a process of attaching the terminal guard 31 to the compressor assembly 111.
Figure 8:
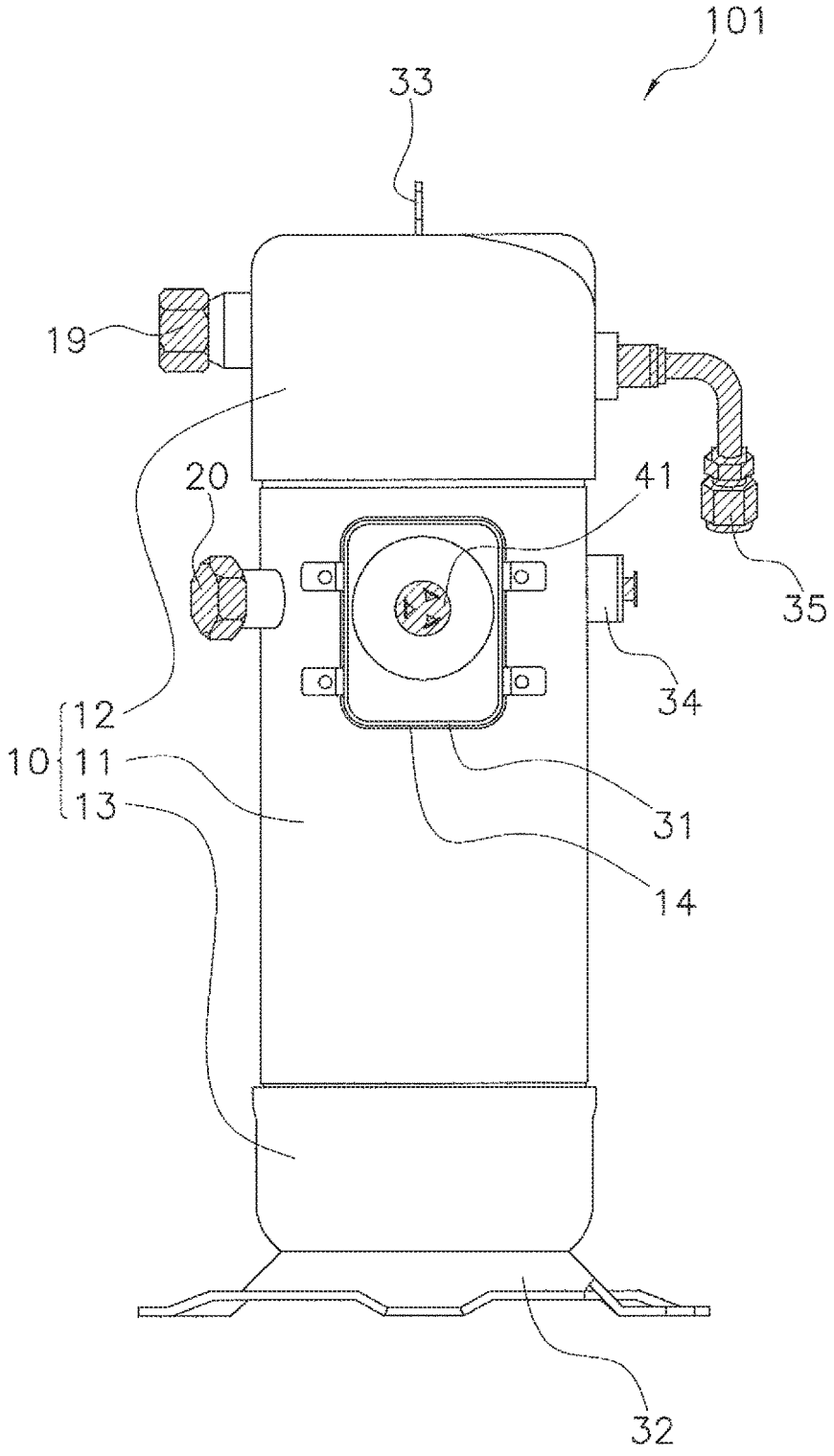
FIG. 8 is a drawing for describing the process of attaching the terminal guard 31 to the compressor assembly 111.

In the process of manufacturing the compressor 101 from the compressor assembly 111, the terminal guard 31 is attached to the compressor assembly 111 by attaching the terminal guard 31 to the terminal guard mounting seat 14. FIG. 6(*a*) is a front view of the terminal guard 31. FIG. 6(*b*) is a bottom view of the terminal guard 31. FIG. 7 and FIG. 8 are drawings for describing the process of attaching the terminal guard 31 to the compressor assembly 111. In the compressor assembly 111, the top portion 12 and the bottom portion 13 are already attached to the middle portion 11. The terminal guard mounting seat 14, the discharge pipe 20, and the sensor mounting seat 34 are attached to the outer surface of the middle portion 11. The terminal 41 projects from the outer surface of the middle portion 11. The hanger 33, the suction pipe 19, and the injection pipe 35 are attached to the outer surface of the top portion 12. The mounting foot 32 is attached to the outer surface of the bottom portion 13.

Here, the details of the terminal guard 31 will be described. The terminal guard 31 has a shape close to a quadrangular prism with curved corner portions. The terminal guard 31 is formed from a resin, a ceramic, or an aluminum alloy, for example, that has corrosion resistance. Because of this, the corrosion resistance of the terminal guard 31 can be improved in a case where the compressor 101 is used in an environment where high corrosion resistance is required, such as a marine environment.

The terminal guard 31 has a curved portion 31*a* that contacts the outer surface of the middle portion 11 when the terminal guard 31 is attached to the terminal guard mounting seat 14. As shown in FIG. 6(*b*), the curved portion 31*a* curves in conformity to the open cylinder shape of the middle portion 11. The terminal guard 31 has a terminal hole 41*a*, through which the terminal 41 passes, and a cable hole 41*b*, to which a later-described cable ground 31*d* is attached. The terminal hole 41*a* is formed in the face that has the curved portion 31*a*. The cable hole 41*b* is formed in the lower face of the terminal guard 31. An opening 31*e* is provided in the side of the terminal guard 31 facing away from the curved portion 31*a* and the outer surface of the middle portion 11.

Four cover securing members 31*b* are attached to the terminal guard 31. The cover securing members 31*b* are members that project outward from the end portion of the terminal guard 31 on the opposite side of the curved portion 31*a*. Each cover securing member 31*b* has one bolt fastening hole 31*c*. The bolt fastening holes 31*c* are holes for passing bolts for securing a terminal cover (not shown in the drawings) to the terminal guard 31. The terminal cover completely covers the open portion of the terminal guard 31.

Figure 9A:
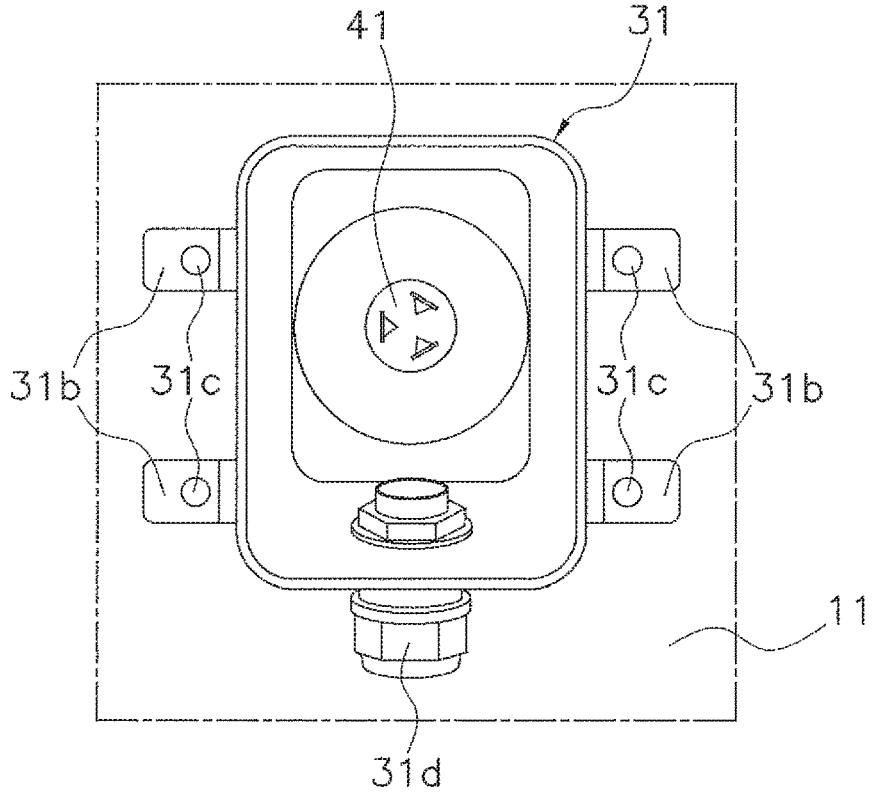
FIG. 9(*a*) is an external view, seen from the front, of the terminal guard 31 attached to the terminal guard mounting seat 14.
Figure 9B:
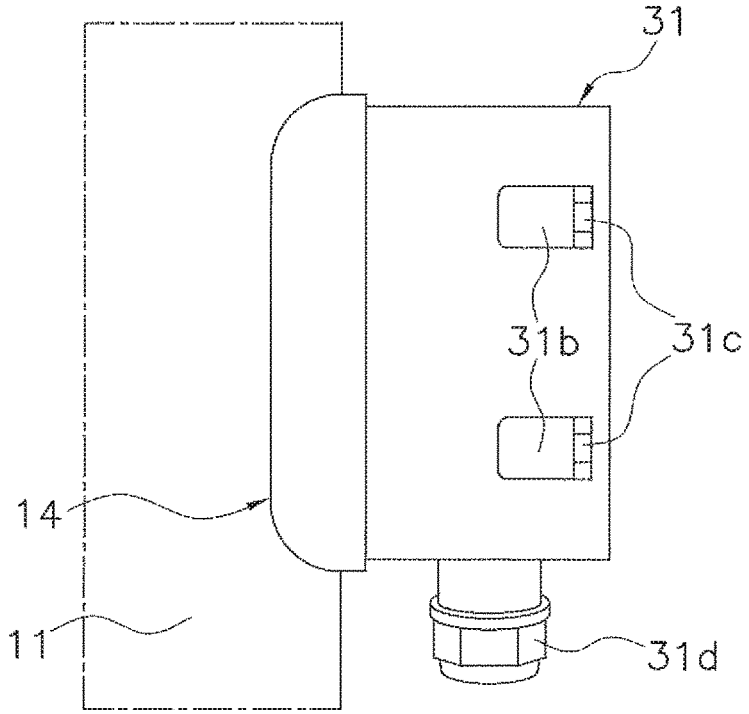

FIG. 9(*a*) is an external view, seen from the front, of the terminal guard 31 attached to the terminal guard mounting seat 14. FIG. 9(*b*) is an external view, seen from the side, of the terminal guard 31 attached to the terminal guard mounting seat 14. The method of attaching the terminal guard 31 to the terminal guard mounting seat 14 is arbitrary.

The gap between the terminal guard 31 and the middle portion 11 and the gap between the terminal guard 31 and the terminal guard mounting seat 14 are filled with a caulking agent. It will be noted that in a case where these gaps are closed by welding, for example, along their entire peripheries, they do not need to be filled with a caulking agent. A cable ground 31*d* is airtightly attached to the cable hole 41*b* in the terminal guard 31. The cable ground 31*d* is a resin part through which a cable connected to the terminal 41 passes. The caulking agent and the cable ground 31*d* prevent water and the like from getting inside the terminal guard 31 to which the terminal cover is attached.

In the process of attaching the terminal guard 31 to the compressor assembly 111, first, parts of the outer surfaces of the middle portion 11, the top portion 12, and the bottom portion 13 are masked. The masked portions are portions where thermal spraying is prohibited in a subsequent thermal spraying process. The portions where thermal spraying is prohibited are, for example, outer surfaces that include portions that become coupled to external parts. In FIG. 7, the masked portions are indicated as hatched regions. In the middle portion 11, the masked portions are the end portion of the discharge pipe 20, the end portion of the sensor mounting seat 34, and the terminal 41. In the top portion 12, the masked portions are the end portion of the suction pipe 19 and the end portion of the injection pipe 35. In the bottom portion 13, the masked portion, if present, is the outer surface on which a thermal spray coating has already been formed.

Next, thermal spraying is administered to the outer surfaces of the middle portion 11, the top portion 12, and the bottom portion 13. Thermal spraying is a surface treatment technique in which a thermal spray material heated to liquid droplets is sprayed onto the surface of a substrate that is a process target to thereby form a coating on the surface. Hereinafter, the coating formed by the thermal spraying will be called a thermal spray coating. The details of the thermal spraying process will be described later. By administering the thermal spraying using a thermal spray material made of metal, a metal thermal spray coating is formed on the outer surfaces of the middle portion 11, the top portion 12, and the bottom portion 13. The thermal spray coating is not formed on the masked portions. In this way, masking is used to prevent the formation of the thermal spray coating. After the thermal spraying has been administered to the outer surfaces of the middle portion 11, the top portion 12, and the bottom portion 13, the masking on the outer surfaces of the middle portion 11, the top portion 12, and the bottom portion 13 is removed.

Next, the terminal guard 31 is fitted into the terminal guard mounting seat 14, and the terminal guard 31 is attached by welding to the terminal guard mounting seat 14. FIG. 8 shows the compressor assembly 111 to which the terminal guard 31 has been attached. In FIG. 8, the portions where the thermal spray coating has not been formed because of masking are indicated as hatched regions.

Through the above series of steps, the process of attaching the terminal guard 31 to the compressor assembly 111 is completed.

(3) Thermal Spraying Process

Figure 10:
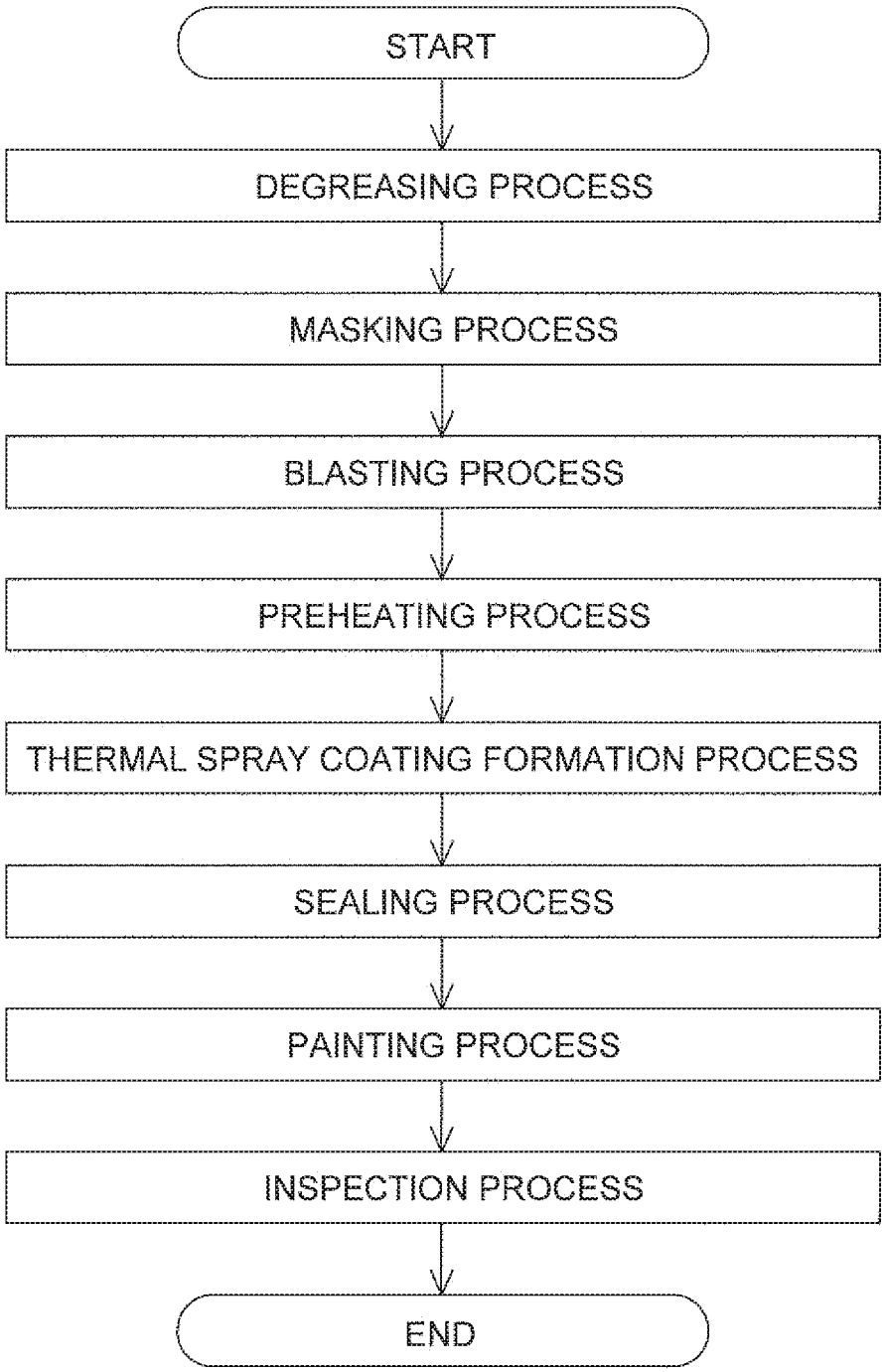
FIG. 10 is a flowchart of a thermal spraying process.

The thermal spraying process will be described in detail. FIG. 10 is a flowchart of the thermal spraying process. The thermal spraying process is configured mainly from a degreasing process, a masking process, a blasting process, a preheating process, a thermal spray coating formation process, a sealing process, a painting process, and an inspection process. Next, as an example, the process of thermal spraying the outer surface of the middle portion 11 to which the top portion 12 and the bottom portion 13 have been attached will be described. Below, the surface on which the thermal spray coating becomes formed will be called a process surface.

(3-1) Degreasing Process

The degreasing process is a process that removes contaminants such as oil sticking to the process surface. The degreasing process is performed to prevent the process surface before it is thermal sprayed from rusting due to contaminants. Furthermore, the degreasing process is performed to remove anti-rust oil that has been applied beforehand to the process surface and contaminants sticking to the process surface. In a case where it is necessary to transfer the compressor assembly 111 after having attached the top portion 12 and the bottom portion 13 to the middle portion 11 to assemble the compressor assembly 111, sometimes it takes time until the blasting process starts. In this case, there is the concern that the process surface will rust due to contaminants during the transfer of the compressor assembly 111. If rust, anti-rust oil, and other contaminants are present on the process surface when the thermal spray coating is formed, the adhesive strength of the thermal spray coating drops, causing a drop in the corrosion resistance of the process surface. Furthermore, even in a case where anti-rust oil has been applied beforehand to the process surface for an anti-rust treatment, if the anti-rust oil remains on the process surface when the thermal spray coating is formed, the adhesive strength of the thermal spray coating drops, causing a drop in the corrosion resistance of the process surface. For that reason, it is necessary to completely remove contaminants from the process surface before the blasting process starts.

(3-2) Masking Process

The masking process is a process that protects masking regions that are portions where the thermal spray coating must not be formed. The masking regions correspond to the aforementioned "portions where thermal spraying is prohibited." The masking regions are outer surfaces to which thermal spraying has already been administered and outer surfaces including portions that become coupled to external parts. The masking regions of the middle portion 11 are the end portion of the discharge pipe 20, the end portion of the sensor mounting seat 34, and the terminal 41, for example. The masking regions of the top portion 12 are the end portion of the suction pipe 19 and the end portion of the injection pipe 35, for example. The masking regions of the bottom portion 13 are the bolt holes in the mounting foot 32, for example.

In the masking process, the masking regions are covered with masking jigs such as heat-resistant masking tape and heat-resistant masking caps. The heat-resistant masking tape is affixed to masking regions that are surfaces having substantially no recessed portions or raised portions. The heat-resistant masking caps are put over masking regions that project from surfaces, such as the end portion of the discharge pipe 20 and the end portion of the suction pipe 19.

(3-3) Blasting Process

The blasting process is a process that roughens the process surface and a process that removes oxide scales sticking to the process surface. The target of the blasting process is the entire process surface where the thermal spray coating is to be formed. The blasting process is performed to improve the ability of the thermal spray coating to adhere to the process surface. The thermal spray coating mechanically adheres to the process surface because of the anchor effect. For that reason, if the surface roughness of the process surface is too low or if contaminants such as oxide scales are sticking to the process surface, there is the concern that the thermal spray coating will become more likely to separate from the process surface.

In the blasting process, a powder abrasive made of iron or aluminum oxide is blasted onto the process surface, whereby the process surface is roughened and oxide scales and the like sticking to the process surface are removed. In order to obtain high adhesive strength between the thermal spray coating and the process surface, the shape and the cleanliness of the process surface after the blasting process are important. For that reason, for the employed blasting process, grit blasting using an abrasive having a pointed shape is preferred over shot blasting using a spherical abrasive. Grit blasting, compared to shot blasting, more easily forms a process surface that has a pointed shape and whose surface roughness is higher. The greater the degree to which the process surface has a pointed shape, the greater the surface area of the process surface becomes. The greater the surface area of the process surface becomes, the greater the contact area between the process surface and the thermal spray coating becomes, so the ability of the thermal spray coating to adhere to the process surface improves. Furthermore, contaminants such as oxide scales sticking to the process surface lower the ability of the thermal spray coating to adhere to the process surface and cause separation of the thermal spray coating. For that reason, it is preferred that the cleanliness of the process surface after the blasting process be as high as possible. Grit blasting, compared to shot blasting, more easily removes contaminants sticking to the process surface. For the above reasons, in the present embodiment, grit blasting is employed.

Furthermore, it is preferred that the material of the abrasive used in the blasting process be a material whose hardness is high, such as aluminum oxide. This is because the higher the hardness of the abrasive is, the higher the surface area and the cleanliness of the process surface after the blasting process become, and the ability of the thermal spray coating to adhere to the process surface tends to improve.

Furthermore, the casing 10 is formed from various materials of different hardnesses, such as steel, stainless steel, casting, and brass. For that reason, it is preferred that the conditions of the blasting process be set in accordance with the materials of the casing 10 so that a shape, surface roughness, and cleanliness that are good for the entire outer surface of the casing 10 are obtained.

(3-4) Preheating Process

The preheating process is a process that heats the process surface before the thermal spray coating is formed on the process surface. The preheating process is performed to improve the ability of the thermal spray coating to adhere to the process surface. If water and contaminants are sticking to the process surface when the thermal spray coating is formed, this causes a drop in the adhesive strength between the thermal spray coating and the process surface. For that reason, it is desired to preheat the process surface, before the thermal spray coating is formed, to remove water and contaminants sticking to the process surface. In order to inhibit degradation of the refrigerating machine oil and the parts (e.g., the compressor, the drive motor, and the crankshaft) housed inside the casing 10, it is preferred that the preheating process be performed in such a way that the temperature of the process surface does not exceed 150°.

(3-5) Thermal Spray Coating Formation Process

The thermal spray coating formation process is a process that uses thermal spraying to form a metal thermal spray coating on the process surface. The thermal spray material used in the thermal spray coating formation process is metal. In a case where the compressor 101 is used in a refrigerating system attached to a marine container, it is preferred that the thermal spray material be aluminum, magnesium, zinc, and an alloy comprising any of these. For the thermal spraying method, an appropriate method is selected from flame spraying, arc spraying, and plasma spraying, for example, in accordance with the thermal spray material.

For the thickness of the thermal spray coating, an appropriate value is set in accordance with, for example, the corrosion resistance required of the process surface, the range of temperature variation in the process surface that occurs when the compressor 101 operates, and the shape of the compressor 101, so that cracks in the thermal spray coating due to internal stress and thermal expansion, for example, do not occur. It is preferred that chamfering be administered beforehand to edge portions of the outer surface of the casing 10 because the thickness of the thermal spray coating tends to become thin at the edge portions.

It is preferred that the time between the blasting process and the thermal spray coating formation process be within 4 hours. This is because there is the concern that the longer the time is between the blasting process and the thermal spray coating formation process, the more likely it will be for the adhesive strength of the thermal spray coating to the process surface to drop because of the activity of the process surface dropping and water and the like sticking to the process surface.

(3-6) Sealing Process

The sealing process is a process that fills holes in the thermal spray coating that has been formed on the process surface. Holes in the thermal spray coating cause a drop in the corrosion resistance of the process surface because the process surface is exposed to outside air. For that reason, the sealing process is performed to inhibit a drop in the corrosion resistance of the process surface. In the sealing process, a sealing agent is applied to the process surface on which the thermal spray coating has been formed.

The sealing process should be performed the day the thermal spray coating formation process was performed. This is because there is the concern that the longer the time is between the thermal spray coating formation process and the sealing process, the more likely it will be for water and contaminants to stick to the process surface and make it harder for the sealing agent to penetrate into the thermal spray coating, so that the corrosion resistance required of the process surface is not obtained.

There are various types of sealing agents, such as silicon resin, acrylic resin, epoxy resin, urethane resin, and fluorocarbon resin. However, from the standpoints of ultraviolet resistance, water resistance, moisture permeability, water repellency, coefficient of linear expansion, and the case of penetration into the thermal spray coating, an appropriate sealing agent should be selected to match the purpose and the use environment of the compressor 101.

As the method of applying the sealing agent, the same method as that used for ordinary painting of the outer surface of the casing 10, such as painting with a brush, spraying with a spray, and immersion in a sealing agent bath, can be used. Before applying the sealing agent, it is desired to preheat the process surface on which the thermal spray coating has been formed to thereby remove water and contaminants, for example, that cause a drop in the adhesive strength of the sealing agent.

For the thickness of the sealing agent that has been applied to the process surface, an appropriate value is selected in accordance with, for example, the corrosion resistance required of the process surface, the range of temperature variation in the process surface that occurs when the compressor 101 operates, and the shape of the compressor 101, so that cracks in the thermal spray coating due to internal stress and thermal expansion, for example, do not occur.

(3-7) Painting Process

The painting process is a process where a paint such as oil paint is applied to the process surface on which the thermal spray coating has been formed, to thereby improve the external appearance. It is preferred that the paint used in the painting process be a paint with a good ability to adhere to the thermal spray coating.

(3-8) Inspection Process

The inspection process is a process of inspecting the process surface on which the thermal spray coating has been formed. Specifically, in the inspection process, the adhesive strength of the thermal spray coating to the process surface and the thickness of the thermal spray coating are measured, and it is determined whether or not the measurement values meet predetermined requirements.

In order to precisely measure the adhesive strength and the thickness of the thermal spray coating, it is preferred that the measurement be performed on a part of the outer surface of the casing 10 that has substantially no recessed portions or raised portions. For that reason, it is preferred that a surface for measuring the adhesive strength and the thickness of the thermal spray coating be formed beforehand on the casing 10.

Furthermore, instead of measuring the adhesive strength and the thickness of the thermal spray coating that has been formed on the outer surface of the casing 10, the adhesive strength and the thickness of the thermal spray coating that has been formed on the surface of a masking jig that was used in the masking process may also be measured. In this case, it is preferred that the material of the masking jig be identical or similar to the material of the casing 10.

(4) Characteristics

The compressor assembly 111 pertaining to the present embodiment is a semi-manufactured product of the compressor 101 and corresponds to the compressor 101 in a state in which the terminal guard 31 for protecting the terminal 41 connected to the power supply has not been attached. Just the terminal guard mounting seat 14 for attaching the terminal guard 31 is attached to the outer surface of the middle portion 11 around the terminal 41. For that reason, when administering metal spraying to the outer surface of the middle portion 11, a good thermal spray coating can also be formed on the outer surface around the terminal guard mounting seat 14. This is because after the terminal guard 31 has been attached to the middle portion 11 it is difficult to spray the thermal spray material from an appropriate direction onto, and therefore difficult to form a good thermal spray coating on, the outer surface that is in the shadow of the terminal guard 31. Consequently, the compressor assembly 111 can manufacture the compressor 101 having a good thermal spray coating formed also around the terminal guard 31. Furthermore, in the compressor assembly 111, terminal guards 31 of various shapes can be attached to the terminal guard mounting seat 14. For that reason, the compressor assembly 111 can manufacture the compressor 101 in which it is easy to replace the terminal guard 31.

In the method of manufacturing the compressor 101 pertaining to the present embodiment, a metal coating for improving corrosion resistance is formed by thermal spraying on the outer surface of the middle portion 11 of the compressor 101 in a state in which the terminal guard 31 for protecting the terminal 41 connected to the power supply has not been attached. When the metal spraying is administered, just the terminal guard mounting seat 14 for attaching the terminal guard 31 is attached to the outer surface of the middle portion 11 around the terminal 41. For that reason, when administering the metal spraying to the outer surface of the middle portion 11, a good thermal spray coating can also be formed on the outer surface around the terminal guard mounting seat 14. This is because after the terminal guard 31 has been attached to the middle portion 11 it is difficult to spray the thermal spray material from an appropriate direction onto, and therefore difficult to form a good thermal spray coating on, the outer surface that is in the shadow of the terminal guard 31. Consequently, in this method of manufacturing the compressor 101, the compressor 101 having a good thermal spray coating formed also around the terminal guard 31 can be manufactured.

Furthermore, in this method of manufacturing the compressor 101, by using stainless steel to make the terminal guard 31, the compressor 101 whose corrosion resistance is high even without administering the metal spraying can be manufactured. For that reason, in a case where the compressor 101 is not used in an environment where high corrosion resistance is required, such as a marine environment, the metal spraying of the terminal guard 31 can be omitted from the manufacturing process of the compressor 101 by using stainless steel to make the terminal guard 31. Consequently, in this case, the cost of the manufacturing process of the compressor 101 can be reduced.

Furthermore, in the compressor 101, the portions where thermal spraying is prohibited, which are parts of the outer surfaces of the middle portion 11, the top portion 12, and the bottom portion 13, are masked. The portions where thermal spraying is prohibited are, for example, outer surfaces to which thermal spraying has already been administered and outer surfaces including portions that become joined to external parts such as refrigerant pipes. Consequently, in the compressor 101, by masking the portions where thermal spraying is prohibited, unnecessary use of thermal spray material resulting from thermal spraying outer surfaces to which thermal spraying has already been administered and poor joining to external parts are inhibited.

Furthermore, in the compressor 101, terminal guards 31 of various shapes can be attached to the terminal guard mounting seat 14. For that reason, in this method of manufacturing the compressor 101, the compressor 101 in which it is easy to replace the terminal guard 31 can be manufactured.

In the present embodiment, the advantages of forming a metal thermal spray coating as the spray coating formed on the outer surfaces of the middle portion 11 and the externally attached parts are as follows.

First, the thermal spray coating that has been formed using as the thermal spray material a metal (e.g., aluminum) whose ionization tendency is greater than that of iron which is the main component of the material of the middle portion 11 and the externally attached parts is corroded before the middle portion 11 and the externally attached parts that are the substrate. For that reason, as long as the thermal spray coating does not separate from the substrate, the anti-corrosion effect whereby corrosion and damage of the substrate due to rust lasts.

Second, compared to a coating of paint whose main component is resin, the difference in the coefficients of linear expansion between a metal thermal spray coating and iron which is the main component of the material of the middle portion 11 and the externally attached parts is small. For that reason, for example, even if during the operation of the compressor 101 a wide temperature variation such as −40° C. to 140° C. arises in the outer surface of the middle portion 11, cracks in the thermal spray coating caused by the difference in the coefficients of linear expansion are less likely to occur.

Third, a metal thermal spray coating allows virtually no water to pass through compared to a coating of paint whose main component is resin. For that reason, separation of the thermal spray coating caused by water passing through the thermal spray coating and accumulating in the boundary between the thermal spray coating and the outer surfaces of the middle portion 11 and the external attached parts that are the substrate is less likely to occur.

Fourth, a metal thermal spray coating has high ductility compared to a coating of paint whose main component is resin. For that reason, blemishes and dimples in the thermal spray coating due to physical stress such as flying rocks are less likely to occur.

Fifth, a metal thermal spray coating has about 5 times the adhesive strength to the outer surfaces of the middle portion 11 and the externally attached parts that are the substrate compared to a coating of paint whose main component is resin. For that reason, separation of the thermal spray coating from the substrate due to deterioration over time is less likely to occur.

Sixth, a metal thermal spray coating has high thermal conductivity compared to a coating of paint whose main component is resin. For that reason, when the compressor 101 has stopped, the heat of high-temperature portions of the outer surface of the casing 10 more easily travels to low-temperature portions, and frost and ice sticking to the outer surface of the casing 10 quickly melt.

(5) Example Modifications

(5-1) Example Modification A

In the embodiment, in a case where the compressor 101 is not used in an environment where high corrosion resistance is required, such as a marine environment, the metal spraying of the terminal guard 31 can be omitted from the manufacturing process of the compressor 101. However, the metal spraying may also be administered to the outer surface of the terminal guard 31.

In the method of manufacturing the compressor 101 pertaining to the present example modification, the metal spraying is administered to the terminal guard 31 before attaching the terminal guard 31 to the terminal guard mounting seat 14. When just the terminal guard 31 is metal sprayed before it is attached to the terminal guard mounting seat 14, it is easier to handle the terminal guard 31 at the time of the thermal spraying than it is when the terminal guard 31 is metal sprayed after it has been attached to the terminal guard mounting seat 14. For that reason, even if the terminal guard 31 has a complex shape, a good metal coating can be formed by spraying the thermal spray material from appropriate directions onto the entire outer surface of the terminal guard 31. Consequently, in this method of manufacturing the compressor 101, a good thermal spray coating can be formed on the terminal guard 31. Furthermore, by forming a thermal spray coating on the terminal guard 31, the corrosion resistance of the terminal guard 31 can be improved in a case where the compressor 101 is used in an environment where high corrosion resistance is required, such as a marine environment.

(5-2) Example Modification B

In the embodiment, the degreasing process for removing contaminants sticking to the process surface before it is thermal sprayed is performed. However, instead of performing the degreasing process, a simple anti-rust treatment may also be performed by applying a paint to the process surface before it is thermal sprayed. In this case, it is preferred to select a paint that can be easily removed from the process surface before blasting the process surface.

(5-3) Example Modification C

In the embodiment, the masking process for protecting the masking regions that are portions of the process surface—before it is thermal sprayed—on which a thermal spray coating must not be formed is performed. However, the masking process may also be performed for the purpose of inscribing predetermined characters and marks, for example, on the process surface in addition to the purpose of protecting the masking regions. Specifically, a masking process where the masking regions are protected by masking jigs in which characters and marks, for example, have been cut out and where thereafter thermal spraying is administered to the process surface and the masking jigs are removed may also be performed. Because of this, characters and marks, for example, are inscribed on the process surface depending on whether or not there is a thermal spray coating.

(5-4) Example Modification D

In the embodiment, the blasting process that uses grit blasting to roughen the process surface is performed. However, a process that roughens the process surface by applying a surface roughening agent to the process surface may also be performed instead of a surface roughening process using grit blasting.

(5-5) Example Modification E

In the embodiment, the thermal spray coating formation process, in which aluminum, magnesium, zinc, and an alloy comprising any of these is used as the thermal spray material, is performed. However, a ceramic or a mixture of a metal and a ceramic may also be used as the thermal spray material. The thermal spray coating formed by such a ceramic thermal spray material has a good ability to block the process surface from the external environment and improves the corrosion resistance of the process surface.

(5-6) Example Modification F

In the embodiment, the thermal spray coating formation process that forms the thermal spray coating on the process surface is performed. However, the thermal spray coating does not need to be a single layer, and a thermal spray coating comprising plural layers may also be formed on the process surface. For example, a thermal spray coating using aluminum, magnesium, zinc, and an alloy comprising any of these as the thermal spray material may be formed on the process surface, and on top of that thermal spray coating another thermal spray coating using a ceramic or a mixture of a metal and a ceramic as the thermal spray material may be formed. A thermal spray coating comprising plural layers has a better ability to block the process surface from the external environment and improves the corrosion resistance of the process surface more than a single-layer thermal spray coating.

(5-7) Example Modification G

In the embodiment, the sealing process that fills holes in the thermal spray coating that has been formed on the process surface is performed. In the sealing process, a resin sealing agent is applied to the process surface on which the thermal spray coating has been formed. However, in the sealing process, a sealing agent containing metal flakes may also be used. In this case, the water transmission rate of the thermal spray coating is reduced by what is called the labyrinth effect, so a drop in the corrosion resistance of the process surface is effectively inhibited.

(5-8) Example Modification H

In the embodiment, as shown in FIG. 5(*a*), the terminal guard mounting seat 14 is a tubular member close to a quadrangular prism with curved corner portions, and as shown in FIG. 9(*b*), the terminal guard 31 is attached by welding to the terminal guard mounting seat 14. However, the terminal guard mounting seat 14 may also be a member with a shape other than a tubular shape, and the terminal guard 31 may also be attached to the terminal guard mounting seat 14 by a method other than welding.

Figure 11:
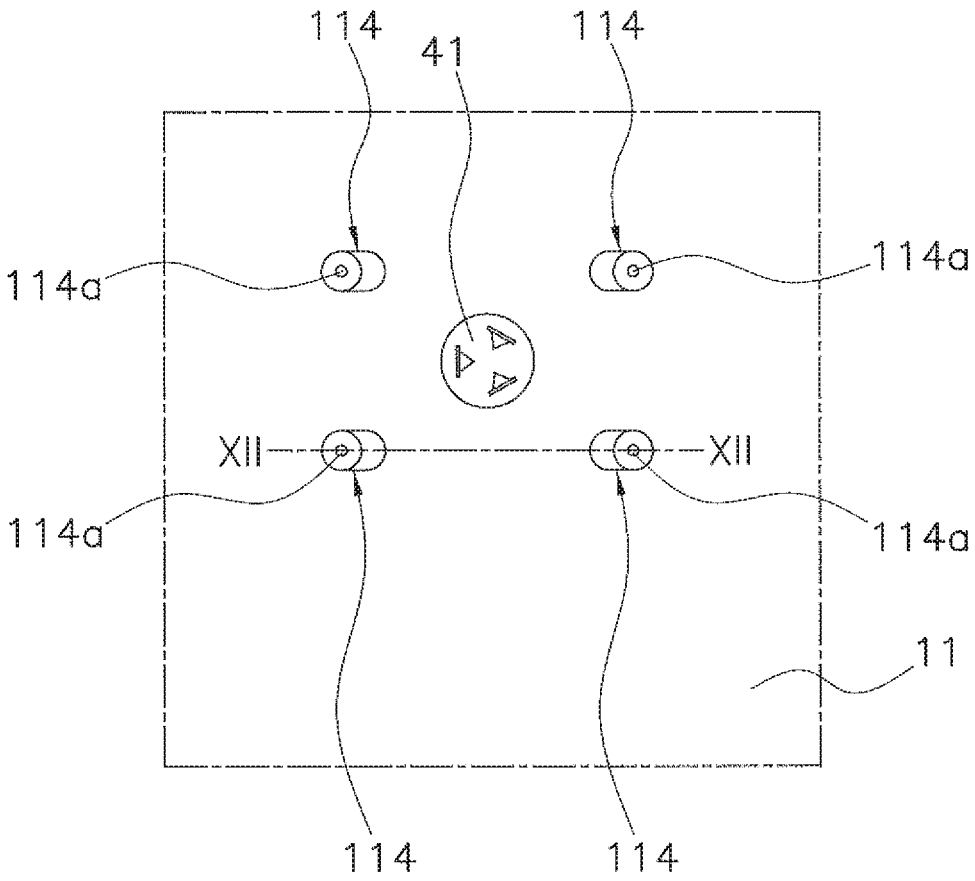
FIG. 11 is an external view, seen from the front, of terminal guard mounting seats 114 attached to the outer surface of the middle portion 11 in example modification H.
Figure 12:
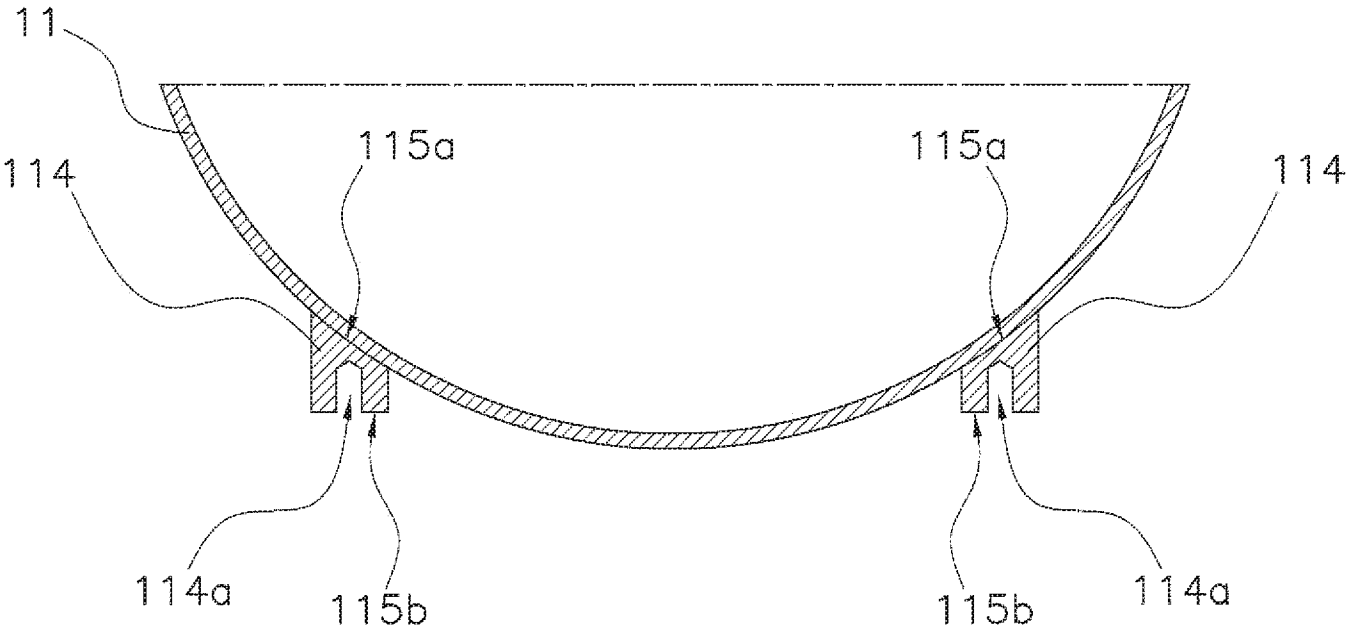
FIG. 12 is a sectional view of the terminal guard mounting seats 114 along line segment XII-XII of FIG. 11.
Figure 13:
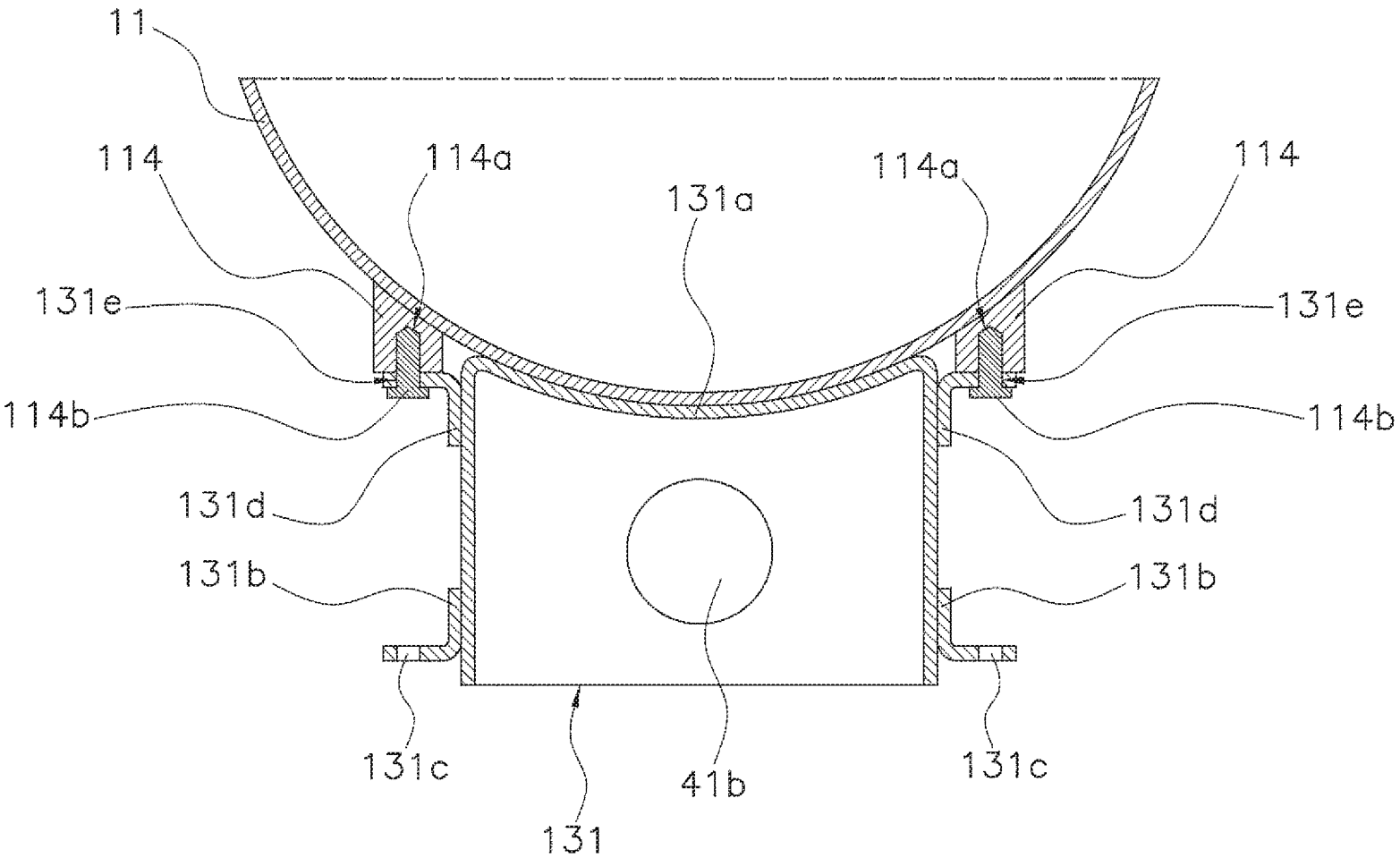
FIG. 13 is a sectional view of the terminal guard mounting seats 114 to which a terminal guard 131 is attached.

FIG. 11 is an external view, seen from the front, of terminal guard mounting seats 114 attached to the outer surface of the middle portion 11 in the present example modification. FIG. 12 is a sectional view of the terminal guard mounting seats 114 along line segment XII-XII of FIG. 11. FIG. 13 is the same sectional view as FIG. 12 and is a sectional view of the terminal guard mounting seats 114 to which a terminal guard 131 has been attached.

In the present example modification, as shown in FIG. 11, four terminal guard mounting seats 114 are attached by welding, for example, to the outer surface of the middle portion 11. As shown in FIG. 12, the terminal guard mounting seats 114 are columnar members having first end portions 115*a* and second end portions 115*b*. The first end portions 115*a* are end portions on the side that becomes attached to the outer surface of the middle portion 11. The second end portions 115*b* are end portions on the opposite side of the first end portions 115*a* and are end portions on the side to which the terminal guard 131 becomes attached. The number of the terminal guard mounting seats 114 is appropriately set in accordance with, for example, the dimensions of the terminal guard 131. The terminal guard mounting seats 114 have screw holes 114*a*. The screw holes 114*a* are formed in end faces on the second end portion 115*b* sides of the terminal guard mounting seats 114.

The terminal guard 131 has a curved portion 131*a*, four cover securing members 131*b*, and four mounting seat securing members 131*d*. The cover securing members 131*b* correspond to the four cover securing members 31*b* of the embodiment and are members that project outward from the end portion of the terminal guard 131 on the opposite side of the curved portion 131*a*. Each cover securing member 131*b* has one bolt fastening hole 131*c*. The bolt fastening holes 131*c* are holes for passing bolts for securing a terminal cover (not shown in the drawings) to the terminal guard 131.

The mounting seat securing members 131*d* are members that project outward from the end portion of the terminal guard 131 on the curved portion 131*a* side. The number of the mounting seat securing members 131*d* is the same as the number of the terminal guard mounting seats 114. Each mounting seat securing member 131*d* has one screw through hole 131*e*. The screw through holes 131*e* are, together with the screw holes 114*a* in the terminal guard mounting seats 114, holes for passing screws 114*b* for securing the terminal guard 131 to the terminal guard mounting seats 114. As shown in FIG. 13, the screws 114*b* pass through the screw through holes 131*e* in the terminal guard 131 and are fitted into the screw holes 114*a* in the terminal guard mounting seats 114.

In the present example modification, the terminal guard 131 is secured to the terminal guard mounting seats 114 by the screws 114*b*, so it is easy to attach, detach, and replace the terminal guard 131.

Furthermore, in the present example modification, instead of attaching the four terminal guard mounting seats 114 to the outer surface of the middle portion 11, the four terminal guard mounting seats 114 may also be coupled to each other and integrated as a member that is attached to the outer surface. In this case, the member corresponding to the four terminal guard mounting seats 114 can be easily attached to the outer surface of the middle portion 11.

(5-9) Example Modification I

In the embodiment, as shown in FIG. 5(*a*), the terminal guard mounting seat 14 is a tubular member close to a quadrangular prism with curved corner portions, and as shown in FIG. 9(*b*), the terminal guard 31 is attached by welding to the terminal guard mounting seat 14. However, the terminal guard mounting seat 14 may also be a member with a shape other than a tubular shape, and the terminal guard 31 may also be attached to the terminal guard mounting seat 14 by a method other than welding.

Figure 14:
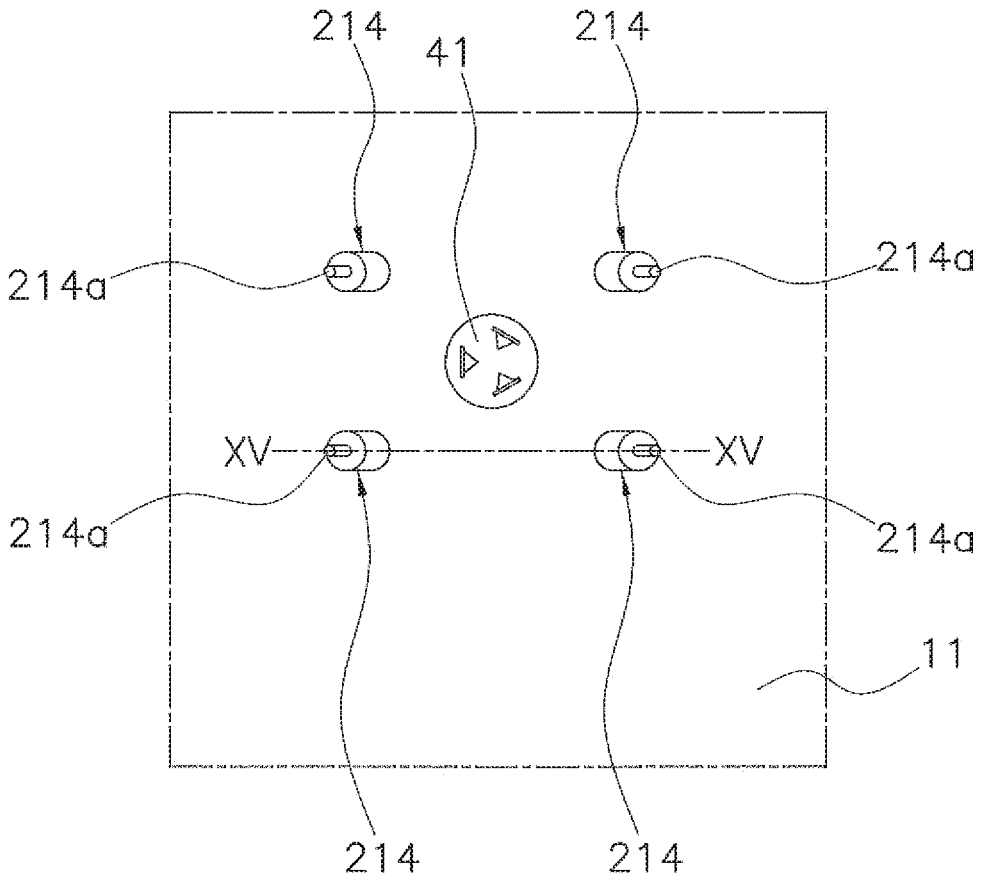
FIG. 14 is an external view, seen from the front, of terminal guard mounting seats 214 attached to the outer surface of the middle portion 11 in example modification I.
Figure 15:
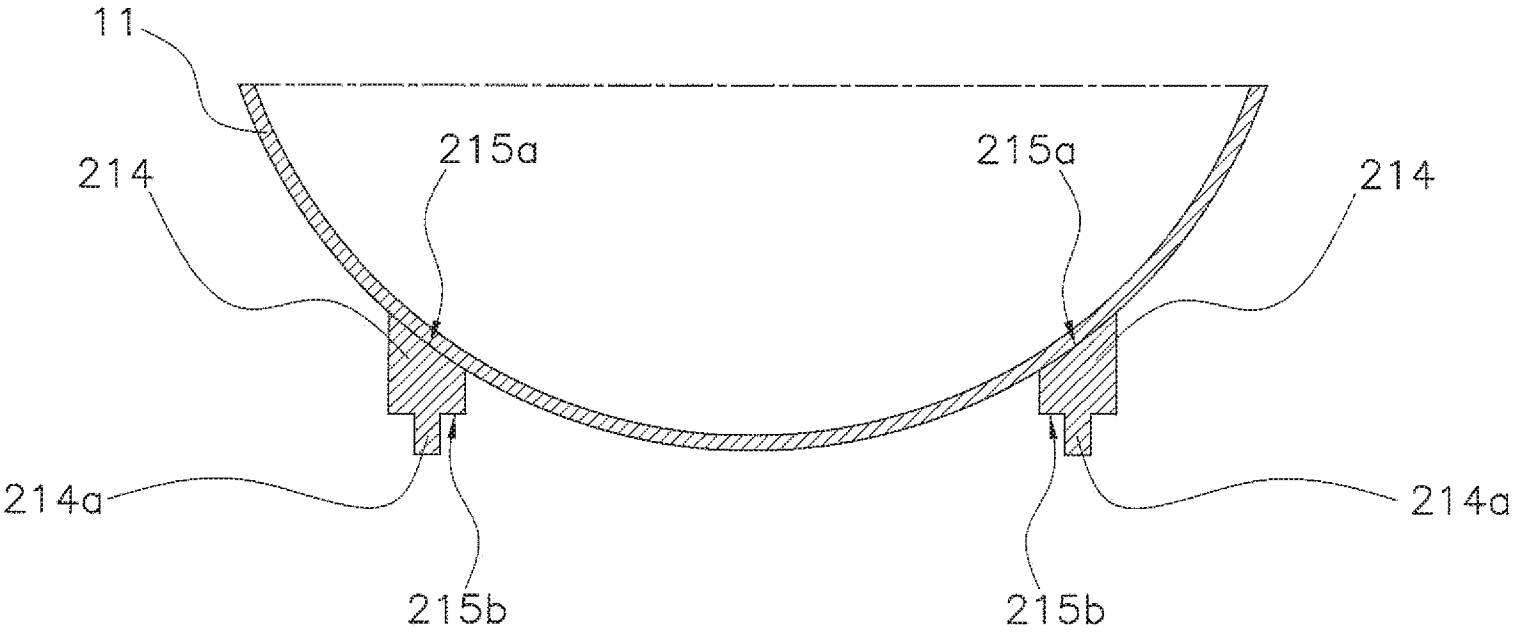
FIG. 15 is a sectional view of the terminal guard mounting seats 214 along line segment XV-XV of FIG. 14.
Figure 16:
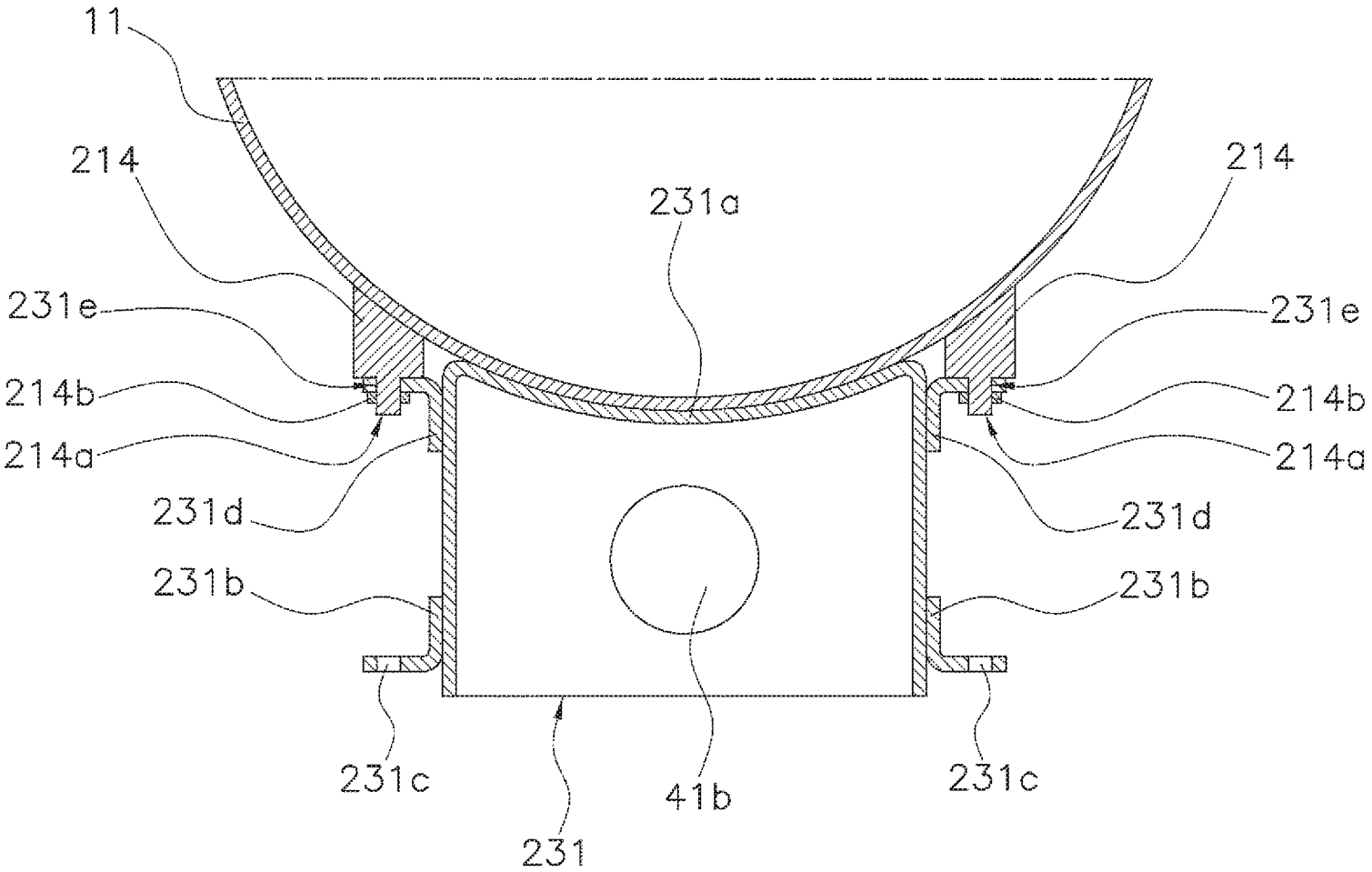
FIG. 16 is a sectional view of the terminal guard mounting seats 214 to which a terminal guard 231 is attached.

FIG. 14 is an external view, seen from the front, of terminal guard mounting seats 214 attached to the outer surface of the middle portion 11 in the present example modification. FIG. 15 is a sectional view of the terminal guard mounting seats 214 along line segment XV-XV of FIG. 14. FIG. 16 is the same sectional view as FIG. 15 and is a sectional view of the terminal guard mounting seats 214 to which a terminal guard 231 has been attached.

In the present example modification, as shown in FIG. 14, four terminal guard mounting seats 214 are attached by welding, for example, to the outer surface of the middle portion 11. As shown in FIG. 15, the terminal guard mounting seats 214 are columnar members having first end portions 215*a* and second end portions 215*b*. The first end portions 215*a* are end portions on the side that becomes attached to the outer surface of the middle portion 11. The second end portions 215*b* are end portions on the opposite side of the first end portions 215*a* and are end portions on the side to which the terminal guard 231 becomes attached. The number of the terminal guard mounting seats 214 is appropriately set in accordance with, for example, the dimensions of the terminal guard 231. The terminal guard mounting seats 214 have ridges 214*a*. The ridges 214*a* are projections formed on end faces on the second end portion 215*b* sides of the terminal guard mounting seats 214.

The terminal guard 231 has a curved portion 231*a*, four cover securing members 231*b*, and four mounting seat securing members 231*d*. The cover securing members 231*b* correspond to the four cover securing members 31*b* of the embodiment and are members that project outward from the end portion of the terminal guard 231 on the opposite side of the curved portion 231*a*. Each cover securing member 231*b* has one bolt fastening hole 231*c*. The bolt fastening holes 231*c* are holes for passing bolts for securing a terminal cover (not shown in the drawings) to the terminal guard 231.

The mounting seat securing members 231*d* are members that project outward from the end portion of the terminal guard 231 on the curved portion 231*a* side. The number of the mounting seat securing members 231*d* is the same as the number of the terminal guard mounting seats 214. Each mounting seat securing member 231*d* has one ridge through hole 231*e*. The ridge through holes 231*e* are holes for passing the ridges 214*a* of the terminal guard mounting seats 214 to secure the terminal guard 231 to the terminal guard mounting seats 214. As shown in FIG. 16, the ridges 214*a* pass through the ridge through holes 231*e* in the terminal guard 231 and are fastened by nuts 214*b*.

In the present example modification, the terminal guard 231 is secured to the terminal guard mounting seats 214 by the nuts 214*b*, so it is easy to attach, detach, and replace the terminal guard 231.

Furthermore, in the present example modification, instead of attaching the four terminal guard mounting seats 214 to the outer surface of the middle portion 11, the four terminal guard mounting seats 214 may also be coupled to each other and integrated as a member that is attached to the outer surface. In this case, the member corresponding to the four terminal guard mounting seats 214 can be easily attached to the outer surface of the middle portion 11.

(5-10) Example Modification J

In the embodiment, as shown in FIG. 5(*a*), the terminal guard mounting seat 14 is a tubular member close to a quadrangular prism with curved corner portions, and as shown in FIG. 9(*b*), the terminal guard 31 is attached by welding to the terminal guard mounting seat 14. However, the terminal guard mounting seat 14 may also be a member with a shape other than a tubular shape.

Figure 17:
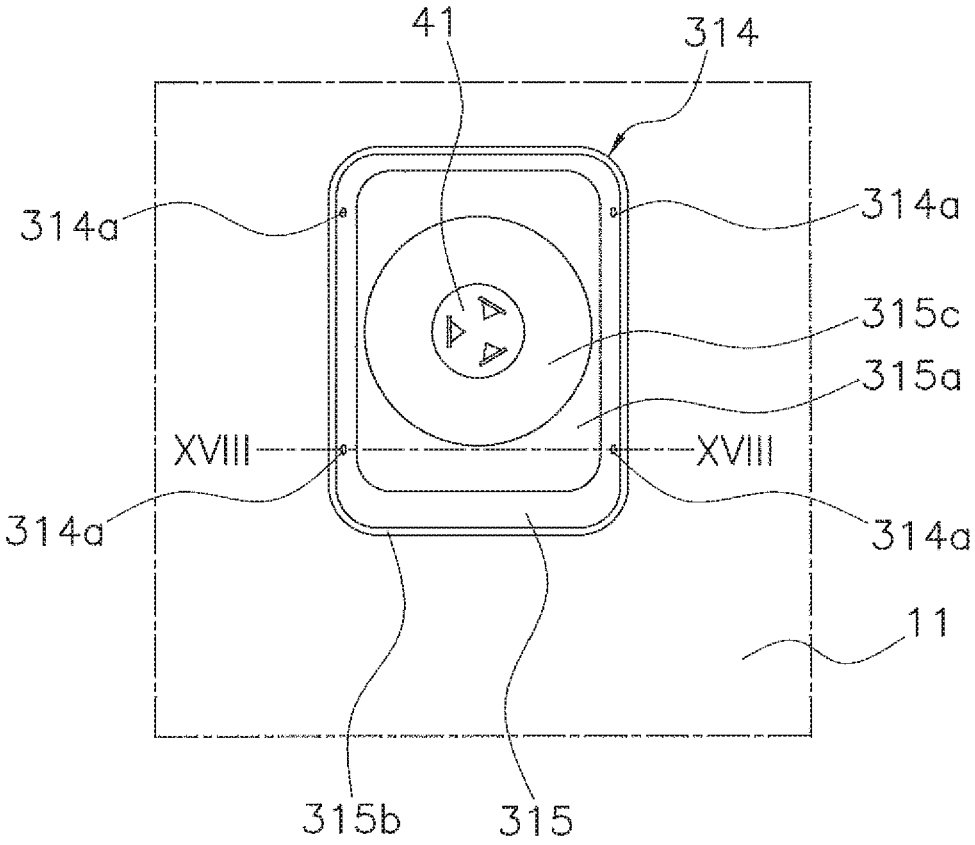
FIG. 17 is an external view, seen from the front, of a terminal guard mounting seat 314 attached to the outer surface of the middle portion 11 in example modification J.
Figure 18:
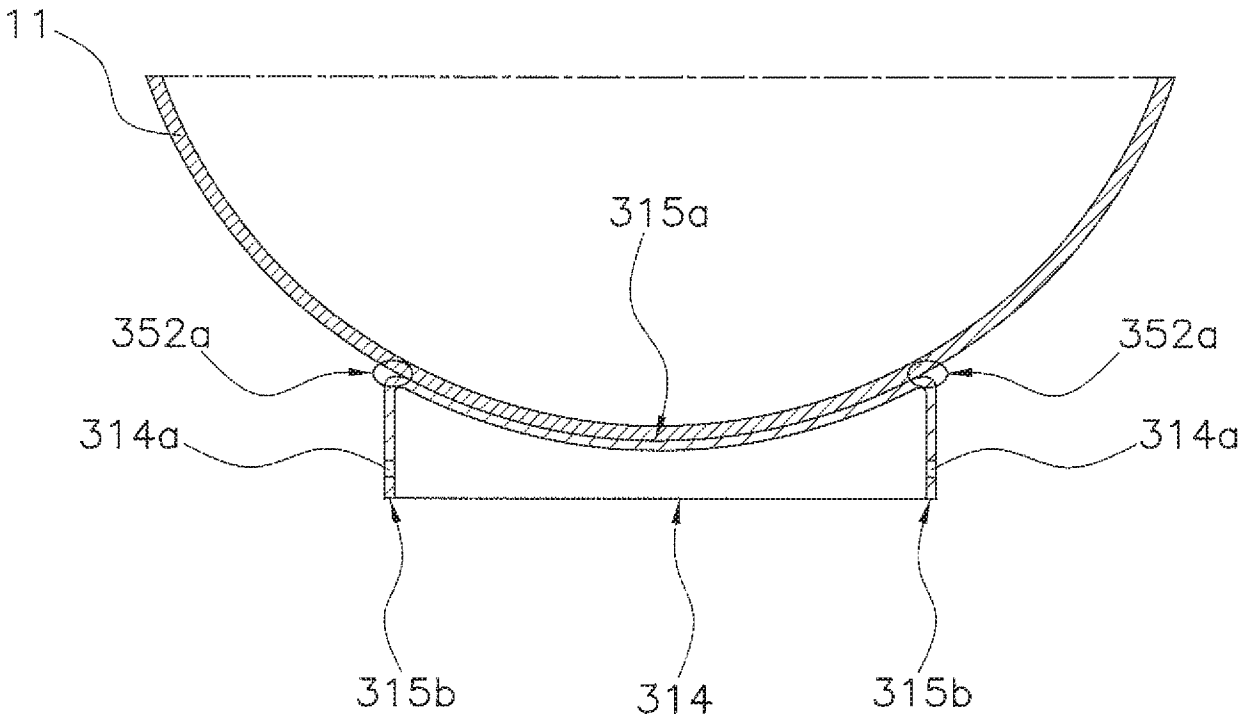
FIG. 18 is a sectional view of the terminal guard mounting seat 314 along line segment XVIII-XVIII of FIG. 17.
Figure 19:
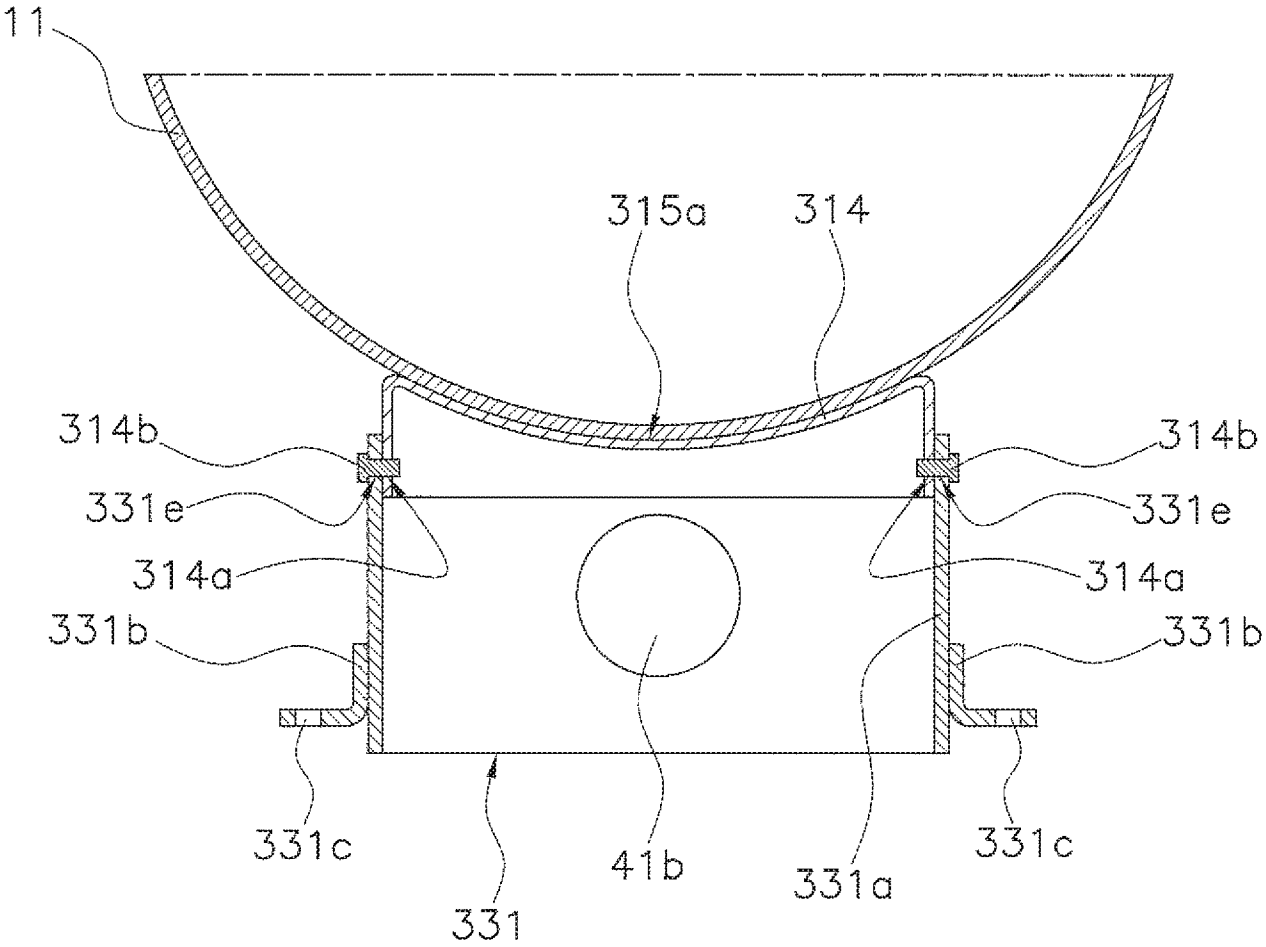
FIG. 19 is a sectional view of the terminal guard mounting seat 314 to which a terminal guard 331 is attached.

FIG. 17 is an external view, seen from the front, of a terminal guard mounting seat 314 attached to the outer surface of the middle portion 11 in the present example modification. FIG. 18 is a sectional view of the terminal guard mounting seat 314 along line segment XVIII-XVIII of FIG. 17. FIG. 19 is the same sectional view as FIG. 18 and is a sectional view of the terminal guard mounting seat 314 to which a terminal guard 331 has been attached.

The terminal guard mounting seat 314 is a bowl-shaped member. Hereinafter, the body of the terminal guard mounting seat 314 will be called a bowl-shaped portion 315. As shown in FIG. 17, the bowl-shaped portion 315 has a bottom portion 315*a* and an end portion 315*b*. The bottom portion

315*a* has a face attached to the outer surface of the middle portion 11 and curves along the shape of the outer surface of the middle portion 11. The bottom portion 315*a* has a terminal hole 315*c* through which the terminal 41 passes. The end portion 315*b* is an end portion on the opposite side of the bottom portion 315*a* and is an end portion on the side to which the terminal guard 331 becomes attached. The terminal guard mounting seat 314 is attached to the outer surface of the middle portion 11 by welding at weld points 352*a* shown in FIG. 18. The weld points 352*a* are formed along the entire periphery of the bottom portion 315*a* of the terminal guard mounting seat 314. The gap between the terminal guard mounting seat 314 and the outer surface of the middle portion 11 is filled with a caulking agent.

The terminal guard mounting seat 314 has four first bolt through holes 314*a*. The first bolt through holes 314*a* are formed in the end portion 315*b* of the terminal guard mounting seat 314. The number of the first bolt through holes 314*a* is appropriately set in accordance with, for example, the dimension of the terminal guard mounting seat 314.

The terminal guard 331 has a tubular body 331*a* and four cover securing members 331*b*. The tubular body 331*a* is a portion into which the terminal guard mounting seat 314 becomes fitted. As shown in FIG. 19, the inner peripheral surface of the tubular body 331*a* contacts the outer peripheral surface of the end portion 315*b* of the terminal guard mounting seat 314. The cover securing members 331*b* correspond to the four cover securing members 31*b* of the embodiment and are members that project outward from the end portion of the tubular body 331*a* on the opposite side of the terminal guard mounting seat 314. Each cover securing member 331*b* has one bolt fastening hole 331*c*. The bolt fastening holes 331*c* are holes for passing bolts for securing a terminal cover (not shown in the drawings) to the terminal guard 331.

The tubular body 331*a* has four second bolt through holes 331*e*. The second bolt through holes 331*e* are holes for passing bolts 314*b* for securing the terminal guard 331 to the terminal guard mounting seat 314. As shown in FIG. 19, the bolts 314*b* pass through the first bolt through holes 314*a* in the terminal guard mounting seat 314 and the second bolt through holes 331*e* in the terminal guard 331 and fasten the terminal guard mounting seat 314 and the terminal guard 331 to each other.

In the present example modification, the terminal guard mounting seat 314 is attached to the outer surface of the middle portion 11 by welding along the entire periphery of the bottom portion 315*a*, so the terminal guard mounting seat 314 can be strongly secured to the outer surface of the middle portion 11. Furthermore, the terminal guard 331 is secured by the bolts 314*b* to the terminal guard mounting seat 314, so it is easy to attach, detach, and replace the terminal guard 331.

Figure 20:
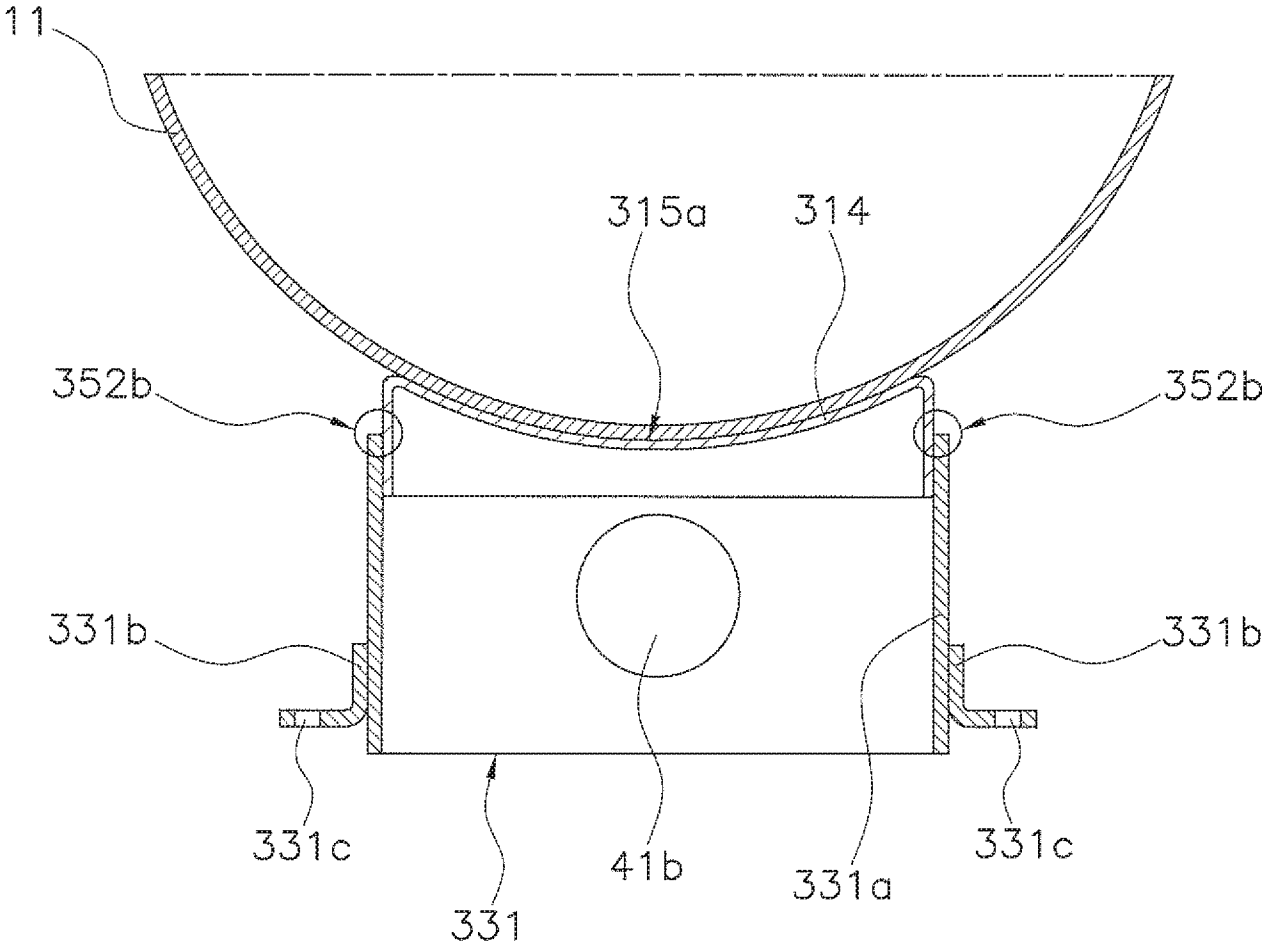
FIG. 20 is the same sectional view as FIG. 19 but shows a configuration where the terminal guard 331 is secured to the terminal guard mounting seat 314 by welding.

Furthermore, in the present example modification, the terminal guard 331 may also be secured to the terminal guard mounting seat 314 by welding. FIG. 20 is the same sectional view as FIG. 19 and shows a configuration where the terminal guard 331 is secured to the terminal guard mounting seat 314 by welding. In FIG. 20, the terminal guard mounting seat 314 does not have the first bolt through holes 314*a*, and the terminal guard 331 does not have the second bolt through holes 331*e*. Instead, the terminal guard 331 is secured to the terminal guard mounting seat 314 by welding at weld points 352*b* shown in FIG. 20. The weld points 352*b* are formed along the entire periphery of the outer peripheral surface of the terminal guard mounting seat 314. Because of this, the terminal guard 331 can be strongly secured to the terminal guard mounting seat 314.

(5-11) Example Modification K

In the embodiment, as shown in FIG. 5(*a*), the terminal guard mounting seat 14 is a tubular member close to a quadrangular prism with curved corner portions, and as shown in FIG. 9(*b*), the terminal guard 31 is attached by welding to the terminal guard mounting seat 14. However, the terminal guard mounting seat 14 may also be a member with a shape other than a tubular shape.

Figure 21:
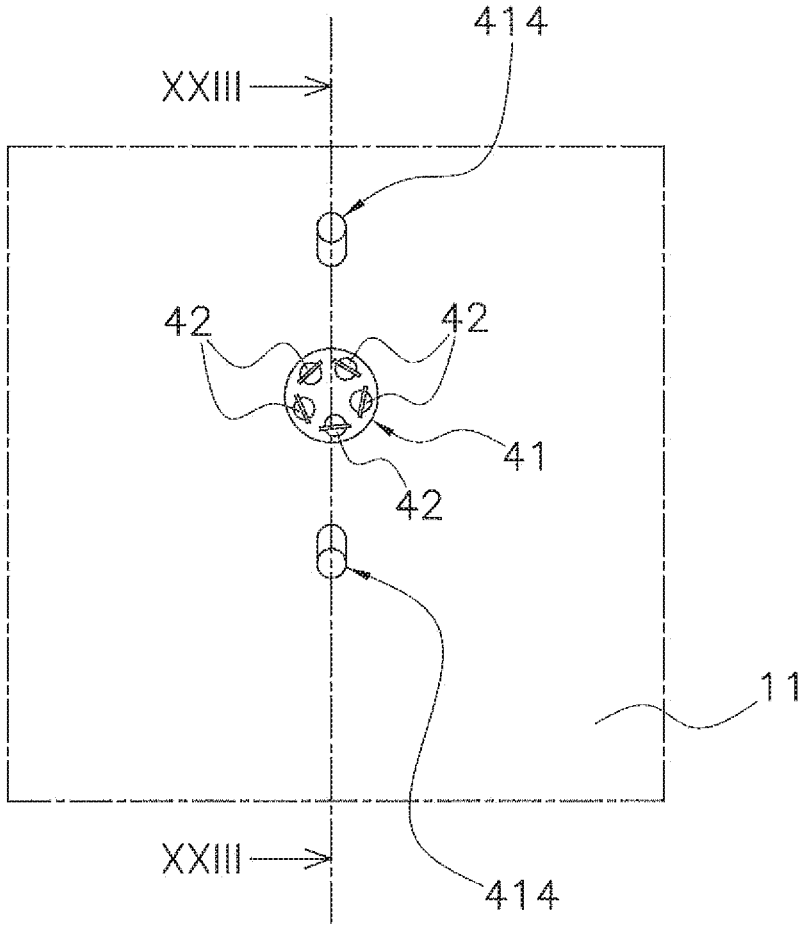
FIG. 21 is an external view, seen from the front, of terminal guard mounting seats 414 attached to the outer surface of the middle portion 11 in example modification K.
Figure 22A:
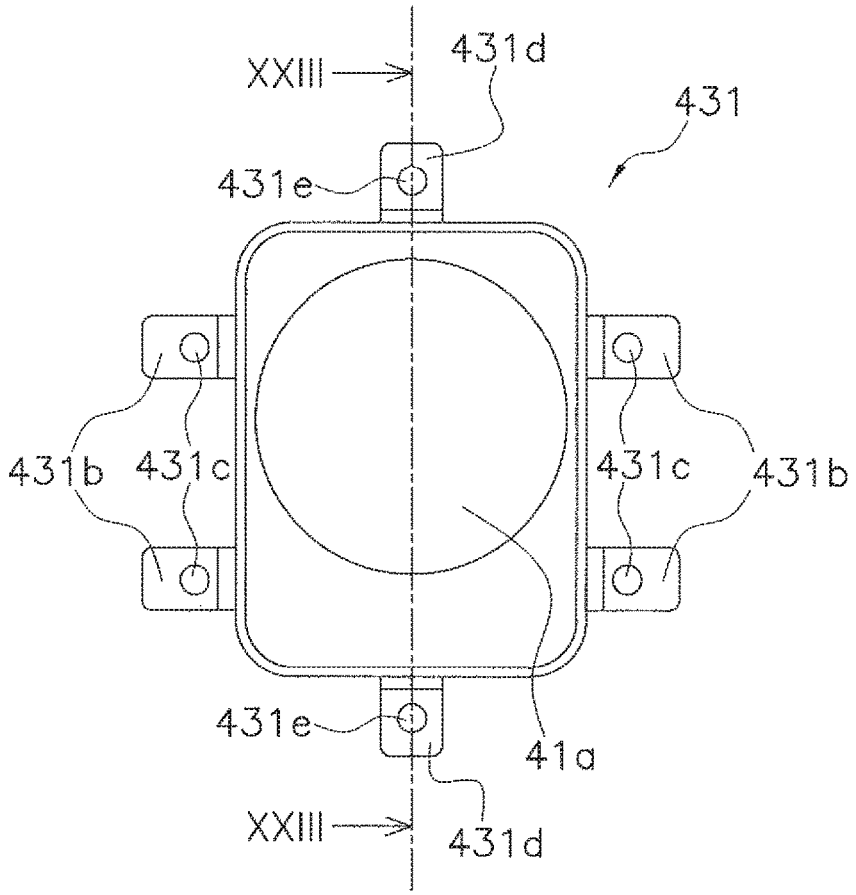
FIG. 22(*a*) is a front view of a terminal guard 431 that becomes attached to the terminal guard mounting seats 414.
Figure 22B:
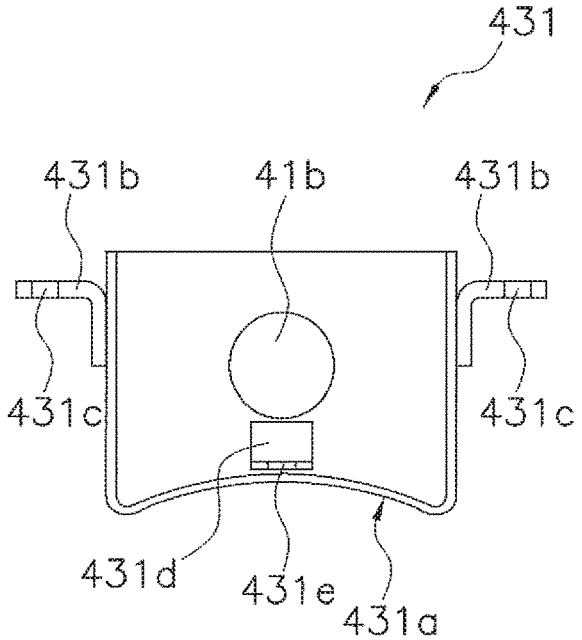
Figure 23:
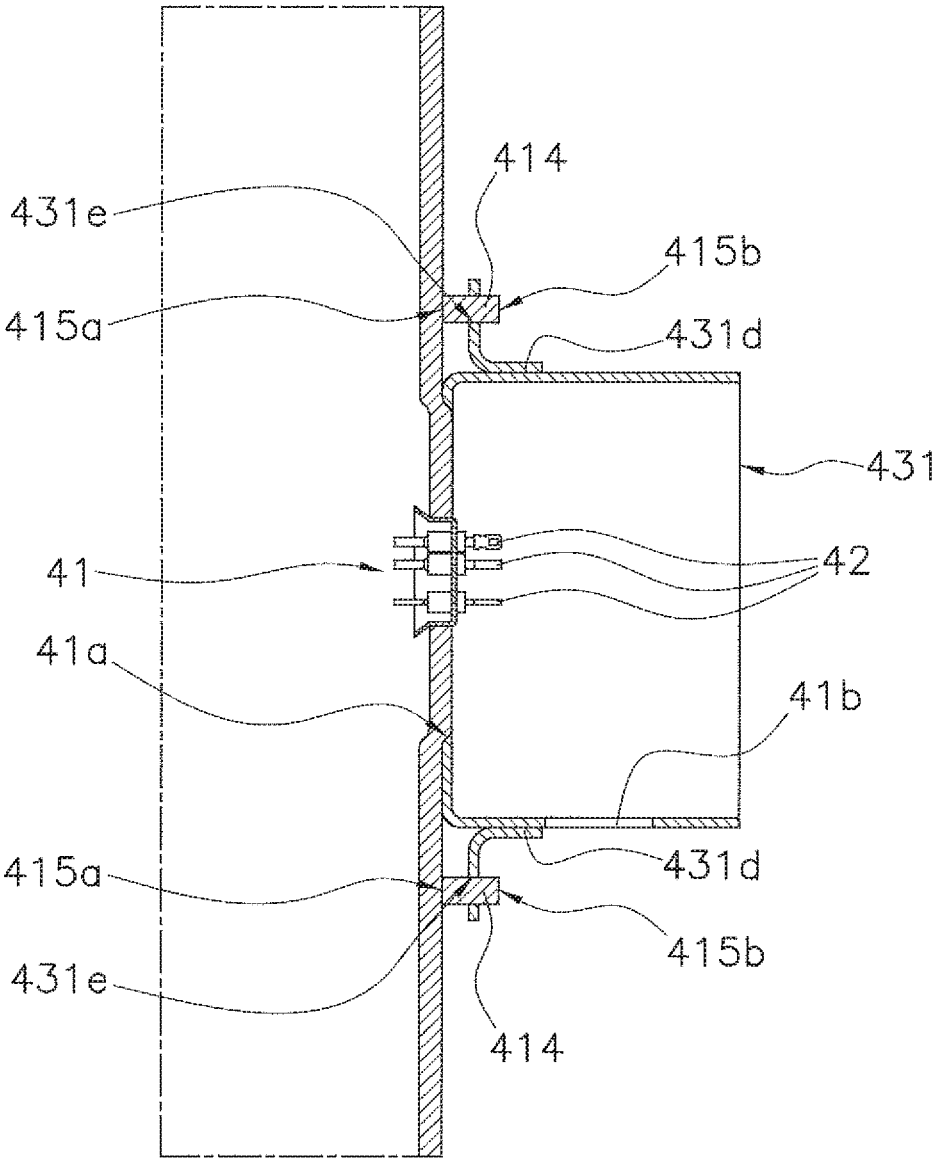
FIG. 23 is a sectional view of the terminal guard mounting seats 414 to which the terminal guard 431 is attached.
Figure 24:
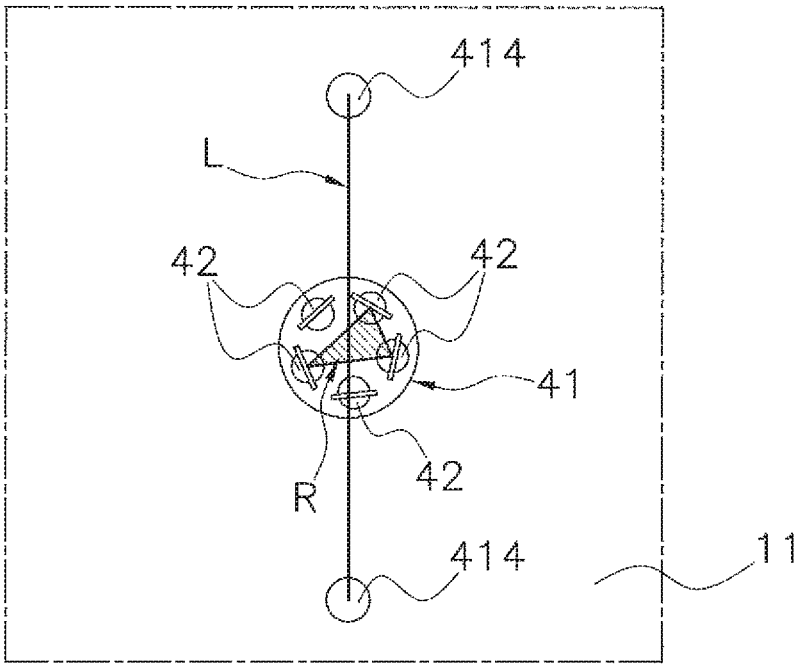
FIG. 24 is a drawing for describing positions of the terminal guard mounting seats 414.

FIG. 21 is an external view, seen from the front, of terminal guard mounting seats 414 attached to the outer surface of the middle portion 11 in the present example modification. FIG. 22(*a*) is a front view of a terminal guard 431 that becomes attached to the terminal guard mounting seats 414. FIG. 22(*b*) is a bottom view of the terminal guard 431. FIG. 23 is a sectional view of the terminal guard mounting seats 414 to which the terminal guard 431 has been attached. FIG. 23 is a sectional view along line segment XXIII-XXIII of FIG. 21 and FIG. 22. FIG. 24 is a drawing for describing positions of the terminal guard mounting seats 414.

In the present example modification, as shown in FIG. 21, two terminal guard mounting seats 414 are attached by welding, for example, to the outer surface of the middle portion 11. The two terminal guard mounting seats 414 are disposed in positions that sandwich the terminal 41. As shown in FIG. 23, the terminal guard mounting seats 414 are columnar members having first end portions 415*a* and second end portions 415*b*. The terminal guard mounting seats 414 are, for example, studs in the shape of closed cylinders. The first end portions 415*a* are end portions on the side that becomes attached to the outer surface of the middle portion 11. The second end portions 415*b* are end portions on the opposite side of the first end portions 415*a* and are end portions on the side to which the terminal guard 431 becomes attached.

As shown in FIG. 22, the terminal guard 431 has a curved portion 431*a*, four cover securing members 431*b*, and two mounting seat securing members 431*d*. The cover securing members 431*b* correspond to the four cover securing members 31*b* of the embodiment and are members that project outward from the end portion of the terminal guard 431 on the opposite side of the curved portion 431*a*. Each cover securing member 431*b* has one bolt fastening hole 431*c*. The bolt fastening holes 431*c* are holes for passing bolts for securing a terminal cover (not shown in the drawings) to the terminal guard 431.

The mounting seat securing members 431*d* are members that project outward from the end portion of the terminal guard 431 on the curved portion 431*a* side. The number of the mounting seat securing members 431*d* is the same as the number of the terminal guard mounting seats 414. Each mounting seat securing member 431*d* has one through hole 431*e*. The through holes 431*e* are holes through which the terminal guard mounting seats 414 pass. In order to attach the terminal guard 431 to the terminal guard mounting seats 414, as shown in FIG. 23, the terminal guard mounting seats 414 secured to the outer surface of the middle portion 11 are passed through the through holes 431*c* in the terminal guard 431 from the side of the second end portions 415*b*. Then, the neighborhoods of the through holes 431*e* are welded to secure the terminal guard 431 to the terminal guard mounting seats 414. In this way, when the terminal guard 431 is secured to the terminal guard mounting seats 414 by welding, the process of attaching the terminal guard 431 is easy and the terminal guard 431 can be strongly secured to the casing 10. It will be noted that instead of using welding to secure the terminal guard 431, the terminal guard 431 may also be secured to the terminal guard mounting seats 414 using securing members such as nuts. For example, in a case where grooves are formed in the surfaces of the terminal guard mounting seats 414, the terminal guard mounting seats 414 may be passed through the through holes 431*e* in the terminal guard 431 and then nuts (securing members) may be attached from the side of the second end portions 415*b* to the terminal guard mounting seats 414 to thereby secure the terminal guard 431.

Furthermore, in the present example modification, instead of attaching the two terminal guard mounting seats 414 to the outer surface of the middle portion 11, the two terminal guard mounting seats 414 may also be coupled to each other and integrated as a member that is attached to the outer surface of the middle portion 11. In this case, the member corresponding to the two terminal guard mounting seats 414 can be easily attached to the outer surface of the middle portion 11.

Furthermore, in the present example modification, the two terminal guard mounting seats 414 are disposed in positions that sandwich the terminal 41. Next, the definition of "positions that sandwich the terminal 41" will be described. As shown in FIG. 21 and FIG. 24, the terminal 41 has plural terminal pins 42 to which a cable, for example, becomes attached. In FIG. 21 and FIG. 24, the terminal 41, which has five terminal pins 42, and the two terminal guard attachment seats 414 are shown. Here, a terminal region R is a triangular region formed by interconnecting the centers of three terminal pins 42 out of the five terminal pins 42. In a case where a line segment L interconnecting the centers of the two terminal guard mounting seats 414 coincides with an arbitrary terminal region R, the two terminal guard mounting seats 414 are disposed in "positions that sandwich the terminal 41". The centers of the terminal pins 42 are the centers of the regions occupied by the terminal pins 42 in a case where the terminal pins 42 are seen from a direction perpendicular to the outer surface of the middle portion 11. The centers of the terminal guard mounting seats 414 are the centers of the regions occupied by the terminal guard mounting seats 414 in a case where the terminal guard mounting seats 414 are seen from a direction perpendicular to the outer surface of the middle portion 11.

It will be noted that in the present example modification the number of the terminal pins 42 and the number of the terminal guard mounting seats 414 are arbitrary. In a case where the number of the terminal guard mounting seats 414 is three or more, it suffices for an arbitrary two of the terminal guard mounting seats 414 to be disposed in positions that sandwich the terminal 41.

(5-12) Example Modification L

In the embodiment and example modifications, the terminal guard mounting seat 14 is attached to the outer surface of the middle portion 11. However, the terminal guard mounting seat 14 may also be attached to the outer surface of the casing 10 somewhere other than the outer surface of the middle portion 11. For example, in a case where the terminal 41 is attached to the outer surface of the top portion 12 of the casing 10, the terminal guard mounting seat 14 may also be attached to the outer surface of the top portion 12.

In the present example modification, in a case where the compressor assembly 111 has a body and a terminal guard attachment seat 14 attached to an outer surface of the body, the body means the casing 10 comprising the middle portion 11, the top portion 12, and the bottom portion 13. Namely, the terminal guard mounting seat 14 may be attached to the outer surface of any of the middle portion 11, the top portion 12, and the bottom portion 13.

Figure 25:
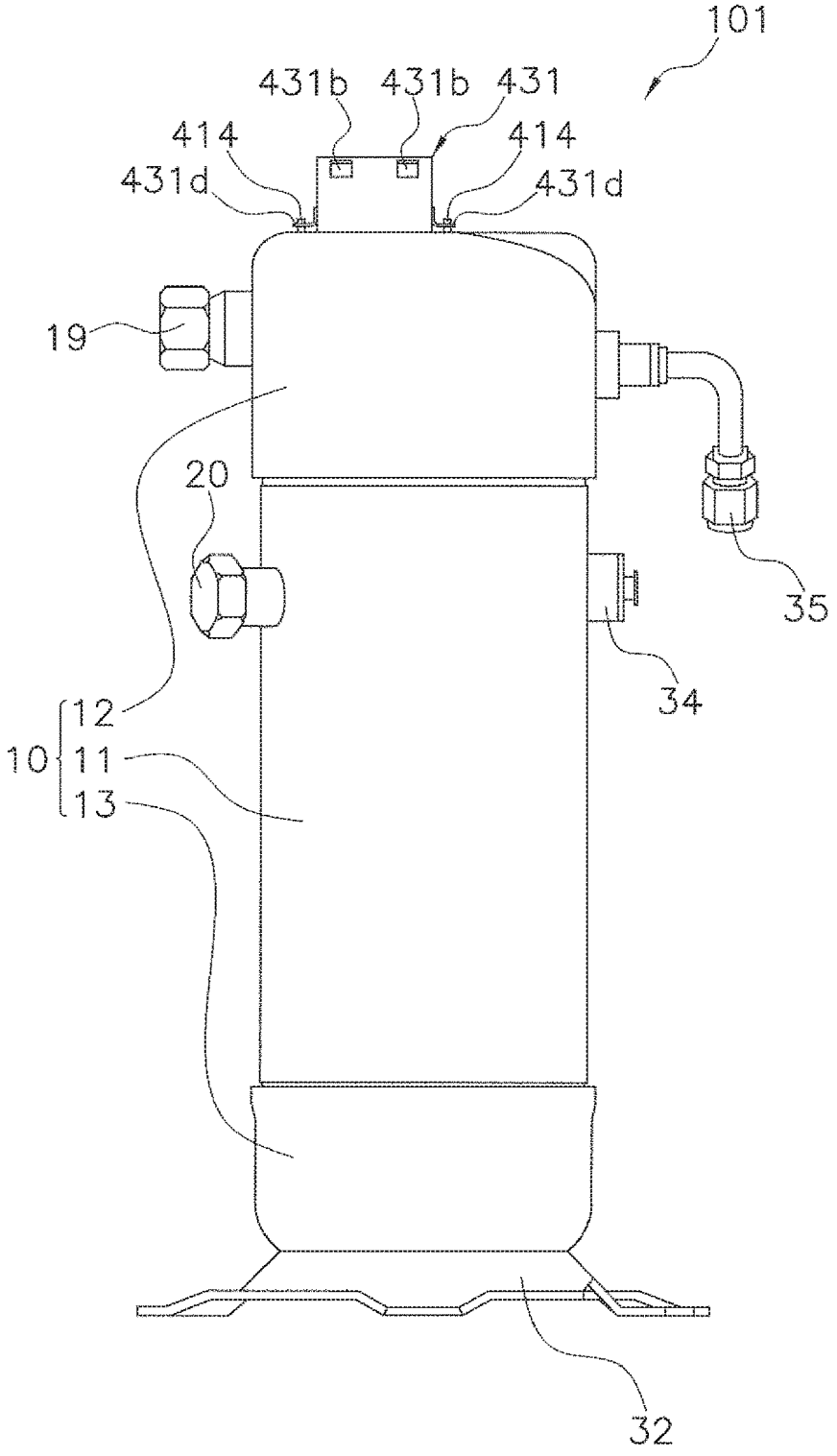
FIG. 25 is an example of a font view of the compressor 101 in example modification L.

FIG. 25 is an example of a front view of the compressor 101 in the present example modification. Substantially the only difference between FIG. 25 and FIG. 1 pertaining to the embodiment is the attachment position of the terminal guard mounting seat. In FIG. 25, the terminal guard mounting seats 414 of example modification K are attached to the bowl-shaped top portion 12 of the casing 10. Specifically, the terminal guard mounting seats 414 are secured by welding to the uppermost face of the top portion 12. Furthermore, in FIG. 25, the terminal guard 431 of example modification K is secured to the terminal guard mounting seats 414. It will be noted that instead of the terminal guard mounting seats 414 of example modification K, any of the terminal guard mounting seat 14 of the embodiment and the terminal guard mounting seats 114, 214, and 314 of example modifications H, I, and J may also be attached to the top portion 12.

INDUSTRIAL APPLICABILITY

The compressor pertaining to the invention has a good thermal spray coating formed around the terminal guard.

What is claimed is:

1. A compressor comprising:

a compressor assembly;

a terminal guard attached to the compressor assembly, the terminal guard having an opening on a side of the terminal guard facing away from the compressor assembly; and a terminal cover attached to the terminal guard and covering the opening, the compressor assembly comprising a body; and a terminal guard mounting seat attached to an outer surface of the body, the terminal guard mounting seat being configured for the terminal guard to be attachable thereto, the terminal guard mounting seat having a first end portion attached to the outer surface and a second end portion spaced away from the outer surface, a distance between the second end portion and the outer surface being shorter than a distance between the opening and the outer surface, the terminal guard including at least one cover securing member configured to secure the terminal cover to the terminal guard, the at least one cover securing member being attached to the terminal guard in a position offset from the opening, the at least one cover securing member being attached to an outer periphery of the terminal guard, and the at least one cover securing member being positioned farther from the outer surface of the body than the second end portion of the terminal guard mounting seat is and closer to the outer surface of the body than an edge of the outer periphery located at the side of the terminal guard facing away from the compressor assembly is.

2. The compressor according to claim 1, wherein metal spraying is administered to at least part of the outer surface of the body.

3. The compressor according to claim 1, wherein the terminal guard is constructed of stainless steel.

4. The compressor according to claim 1, wherein the terminal guard is erectly provided around a terminal that projects from the outer surface.

5. The compressor according to claim 4, wherein the terminal guard is attached to the terminal guard mounting seat by securing members or welding.

6. The compressor according to claim 4, wherein the terminal guard mounting seat has a tubular portion that includes the first end portion and the second end portion.

7. The compressor according to claim 4, wherein the terminal guard mounting seat has a columnar portion that includes the first end portion and the second end portion.

8. The compressor according to claim 7, wherein the terminal guard mounting seat has at least two columnar portions disposed in positions that sandwich the terminal.

9. The compressor according to claim 4, wherein the first end portion of the terminal guard mounting seat has a bowl-shaped portion, a bottom portion of the bowl-shaped portion is attached to the outer surface, and the second end portion is disposed on an opposite side of the bottom portion as the outer surface and has the terminal guard attached thereto.

10. A method of manufacturing the compressor of claim 4, the method comprising:

attaching the terminal guard mounting seat to the outer surface;

administering metal spraying to at least part of the outer surface after attaching the terminal guard mounting seat; and attaching the terminal guard to the terminal guard mounting seat after the administering metal spraying.

11. The compressor manufacturing method according to claim 10, further comprising:

administering metal spraying to the terminal guard before attaching the terminal guard to the terminal guard mounting seat, the attaching of the terminal guard to the terminal guard mounting seat includes attaching the terminal guard to which the metal spraying has been administered.

12. The compressor according to claim 3, wherein the terminal guard is erectly provided around a terminal that projects from the outer surface.

13. The compressor according to claim 5, wherein the terminal guard mounting seat has a tubular portion that includes the first end portion and the second end portion.

14. The compressor according to claim 5, wherein the terminal guard mounting seat has a columnar portion that includes the first end portion and the second end portion.

15. The compressor according to claim 5, wherein the first end portion of the terminal guard mounting seat has a bowl-shaped portion, a bottom portion of the bowl-shaped portion is attached to the outer surface, and the second end portion is disposed on an opposite side of the bottom portion as the outer surface and has the terminal guard attached thereto.

16. The compressor according to claim 1, wherein the at least one cover securing member includes a plurality of cover securing members.

17. The compressor according to claim 1, wherein the at least one cover securing member projects outward from the outer periphery of the terminal guard.

18. The compressor according to claim 1, wherein the terminal guard is attached to the terminal guard mounting seat, the terminal cover is attached to the at least one cover securing member, and the attachment of the terminal guard to the terminal guard mounting seat is independent from the attachment of the terminal cover to the at least one cover securing member.

19. The compressor according to claim 18, wherein the terminal guard is attached to the terminal guard mounting seat with at least one first securing member, the terminal cover is attached to the at least one cover securing member with at least one second securing member, the at least one first securing member and the at least one second securing member discrete from each other.

20. The compressor according to claim 1, wherein the at least one cover securing member is a discrete member attached to the terminal guard.

* * * * *